US012746436B1

(12) United States Patent
Lurie

(10) Patent No.: US 12,746,436 B1
(45) Date of Patent: Sep. 29, 2026

(54) EXERCISE EQUIPMENT WITH PERSONALIZED AND AUTOMATED ADJUSTMENT OF ERGONOMIC FEATURES

(71) Applicant: William Lurie, Alamo, CA (US)

(72) Inventor: William Lurie, Alamo, CA (US)

( * ) Notice: Subject to any disclaimer, the term of this patent is extended or adjusted under 35 U.S.C. 154(b) by 98 days.

(21) Appl. No.: 18/768,698

(22) Filed: Jul. 10, 2024

(51) Int. Cl.
*A63B 24/00* (2006.01)
*A63B 21/005* (2006.01)
*A63B 22/06* (2006.01)

(52) U.S. Cl.
CPC ..... *A63B 24/0062* (2013.01); *A63B 21/0058* (2013.01); *A63B 22/0605* (2013.01); *A63B 2024/0093* (2013.01); *A63B 2220/13* (2013.01); *A63B 2220/16* (2013.01); *A63B 2225/096* (2013.01)

(58) Field of Classification Search
CPC ..... A63B 24/0062; A63B 21/0058; A63B 22/0605; A63B 2024/0093; A63B 2220/13; A63B 2220/16; A63B 2225/096
See application file for complete search history.

(56) References Cited

U.S. PATENT DOCUMENTS 6,050,585 A 4/2000 Rai
8,485,945 B2 * 7/2013 Leonhard ..... A63B 22/0664 482/52
9,061,174 B2 * 6/2015 Jun ..... A63B 22/0046
10,513,300 B2 12/2019 Bowers
10,676,146 B2 6/2020 Hara et al.
10,953,950 B2 3/2021 Komatsu et al.
11,203,388 B2 12/2021 Komatsu et al.
2002/0055417 A1 * 5/2002 Alessandri ..... A63B 21/4047 482/8

(Continued)

FOREIGN PATENT DOCUMENTS

WO 2022/220733 A1 10/2022
WO 2022/226365 A1 10/2022

(Continued)

OTHER PUBLICATIONS

"NordicTrack", web page, 14 Pages, 2024.

*Primary Examiner* — Sundhara M Ganesan
(74) *Attorney, Agent, or Firm* — Peter Gordon

(57) ABSTRACT

Exercise equipment accessed by multiple people includes a user interface that allows users to log into their accounts, position the ergonomic features of the exercise equipment to their preference, and save the settings to their account. During subsequent login sessions, the exercise equipment loads their user-specific settings from their account. The exercise equipment uses these settings to electromechanically drive the various ergonomic features into position. By providing electromechanically controlled mechanisms that allow automated adjustment of positions of ergonomic features, settings for positions of such ergonomic features can be stored and personalized for each user. Storing and automating setup of ergonomic features on exercise equipment to user-specific settings improves the ease of setup and use of exercise equipment and reduces the likelihood of injury. Users can enable their settings on compatible equipment when traveling or even when using a different instance of the same equipment within their usual gym.

11 Claims, 29 Drawing Sheets

(56) References Cited

U.S. PATENT DOCUMENTS

2008/0058170 A1* 3/2008 Giannascoli ..... A63B 69/16 482/57
2011/0077125 A1* 3/2011 Kenyon ..... A63B 22/0605 482/4
2011/0237397 A1* 9/2011 Mabey ..... A63B 22/0605 482/4
2011/0263388 A1* 10/2011 Tamari ..... A63B 22/0015 482/57
2013/0065733 A1* 3/2013 Kautz ..... A63B 22/0605 482/57
2013/0072356 A1* 3/2013 Machida ..... A63B 22/0023 482/58
2013/0190136 A1* 7/2013 Watterson ..... A63B 24/00 482/8
2013/0225370 A1 8/2013 Flynt et al.
2014/0150578 A1* 6/2014 Villaume ..... A63B 22/0605 74/89
2014/0221158 A1* 8/2014 Mabey ..... A63B 22/0046 482/4
2014/0379135 A1* 12/2014 Kristiansen ..... G05B 13/02 700/275
2015/0174446 A1* 6/2015 Chiang ..... A63B 22/0605 482/8
2020/0269941 A1 8/2020 Hara
2021/0060380 A1* 3/2021 Hawkins, III ..... A63B 21/005
2022/0395729 A1 12/2022 Toth
2023/0023599 A1 1/2023 Coaplen et al.
2025/0288863 A1* 9/2025 Lohrengel ..... A63B 21/4035

FOREIGN PATENT DOCUMENTS

WO 2022/256652 A1 12/2022
WO 2023/059522 A1 4/2023

* cited by examiner

EXERCISE EQUIPMENT WITH PERSONALIZED AND AUTOMATED ADJUSTMENT OF ERGONOMIC FEATURES

BACKGROUND

A single piece of exercise equipment often is used by multiple people. Such use may occur at, for example, a fitness club, shared residence gym, hotel gym, or within a home. When exercise equipment is shared, each user typically must adjust the position of user-specific ergonomic features prior to use. In the example of an exercise cycle or stationary cycle, this may include the height, tilt angle, or lateral position of a seat, or height, tilt angle, or lateral position of handlebars.

A single person often uses many different pieces of exercise equipment. Modern exercise equipment typically includes a computer with video and audio output and computer network or other device connectivity, whether wired, wireless, or both. Such exercise equipment can be used to collect and store information about exercises performed using the different pieces of exercise equipment to track training progress. Also, such systems can provide interactive fitness programs and track training progress.

SUMMARY

This Summary introduces a selection of concepts in simplified form that are described further below in the Detailed Description. This Summary neither identifies key or essential features, nor limits the scope, of the claimed subject matter.

While user accounts for modern, shared exercise equipment provide a breadth of user-specific information and customization for end users, end users still typically manually set the physical positions of ergonomic features of the exercise machines. Ergonomic features are those elements of the exercise machines that have adjustable positions to accommodate different sizes of individuals. For example, end users typically manually set vertical and horizontal positions, and tilt, of seats and handlebars. Conventional exercise equipment lacks mechanisms that allow automated adjustment of ergonomic features or storage of settings for ergonomic features.

To address these issues, exercise equipment accessed by multiple people includes ergonomic features with electromechanically controlled positioning elements to allow automated adjustment. By providing electromechanically controlled mechanisms that allow automated adjustment of ergonomic features, settings for positions of such ergonomic features can be stored and personalized for each user. The exercise equipment includes a user interface that allows users to log into accounts, position the ergonomic features of the exercise equipment to their preferences, and save the settings for the positions of the ergonomic features to their accounts. During subsequent login sessions, the exercise equipment loads their user-specific settings for the positions of the ergonomic features from their accounts. The exercise equipment uses these settings to electromechanically drive the various ergonomic features into position.

Storing positions for, and automating setup of, ergonomic features on exercise equipment to user-specific settings for positions of ergonomic features improves the ease of setup and use of exercise equipment and reduces the likelihood of injury.

Web-based user accounts also enable broad portability of the user-specific settings for the positions of ergonomic features. For example, users can enable their settings on compatible equipment when traveling or even when using a different instance of the same equipment within their usual gym.

These techniques enhance comfort and safety of users of equipment by adjusting the structures of the equipment into an optimal ergonomic position. Providing optimal positioning reduces risk of injury or development of musculoskeletal disorders and improves exercise efficacy.

Accordingly, in one aspect, exercise equipment has a frame comprising a plurality of interconnected members. A post is configured to be installed in a first member of the plurality of interconnected members and configured to be connected to a support component adapted to be physically engaged by a body part of an individual using the exercise equipment. A motor assembly includes a motor affixed to the frame and a moving member connected to the post. The moving member is configured to be moved by the motor in response to a drive signal input to the motor assembly to move the post along the first member with a range of motion between a first position and a second position. A sensor is configured to sense a current position of the moving member along the range of motion and having an output providing a signal indicative of the current position. A computing device includes computer program instructions that configure the computing device. The computing device receives data describing a desired position of the post, receives data based on the signal indicative of the current position of the post, determines a drive amount for the motor assembly based on at least the desired position and the current position of the post, and outputs the drive signal to the motor assembly based on the determined drive amount.

In one aspect, an adjustable seat assembly for exercise equipment includes a seat post configured to be installed in a seat tube of a frame. A motor assembly includes a motor configured to be affixed to the frame and a moving member connected to the seat post. The moving member is configured to be moved by the motor in response to a drive signal input to the motor assembly to move the seat post along the seat tube with a range of motion between a first position and a second position. A sensor is configured to sense a current position of the seat post along the range of motion and has an output providing a signal indicative of the current position. A seat bracket is formed on the seat post and configured to receive a saddle.

In one aspect, an adjustable handlebar assembly for exercise equipment includes a stem configured to be installed in a head tube of a frame. A motor assembly includes a motor configured to be affixed to the frame and a moving member connected to the stem. The moving member is configured to be moved by the motor in response to a drive signal input to the motor assembly to move the stem along the head tube with a range of motion between a first position and a second position. A sensor is configured to sense a current position of the moving member along the range of motion and has an output providing a signal indicative of the current position. A bracket is formed on the stem and configured to receive handlebars.

In one aspect, an adjustable ergonomic feature for exercise equipment includes a post configured to be installed in a tube of a frame of the exercise equipment. The post is configured to be connected to a support component adapted to be physically engaged by a body part of an individual using the exercise equipment. A motor assembly includes a motor configured to be affixed to the frame. A moving member is connected to the post. The moving member is configured to be moved by the motor in response to a drive signal input to the motor assembly to move the post along the tube with a range of motion between a first position and a second position. A sensor is configured to sense a current position of the moving member along the range of motion and has an output providing a signal indicative of the current position.

In one aspect, an ergonomic feature of exercise equipment adjustably mounts a support component to the exercise equipment. The support component is adapted to be physically engaged by a body part of an individual using the exercise equipment and to have an adjustable lateral position with respect to the exercise equipment. The ergonomic feature includes a post configured to be installed in a tube of a frame of the exercise equipment. The ergonomic feature includes a motor assembly including a motor configured to be affixed to the post and a moving member adapted to be connected to a bracket. The moving member is configured to be moved by the motor in response to a drive signal input to the motor assembly to move the moving member laterally with respect to the post with a range of motion between a first position and a second position. The bracket is adapted to connect the support component to the moving member. A sensor is configured to sense the current position of the moving member along the range of motion and has an output providing a signal indicative of the current position. The range of motion can be angular. The range of motion can be linear.

In one aspect, a computing device for exercise equipment includes a processing system comprising a processing unit, computer storage, and computer program instructions that, when processed by the processing unit, configure the processing system. The configured processing system receives data describing a desired position of an adjustable ergonomic feature of the exercise equipment, receives data based on a signal from a sensor of the exercise equipment indicative of a current position of the adjustable ergonomic feature, determines a drive amount for a motor assembly of the exercise equipment based on at least the desired position and the current position, and outputs a drive signal to the motor assembly based on the determined drive amount.

In one aspect, a computing system supports use of exercise equipment by a plurality of individuals. The computing system includes a database comprising computer storage and data stored in the computer storage. The data includes, for each individual of a plurality of individuals, respective position data for one or more adjustable ergonomic features of the exercise equipment as used by the individual. The computing system includes a processing system comprising a processing unit, computer storage, and computer program instructions that, when processed by the processing unit, configure the processing system. The configured processing system receives, over a computer network, message data from a computing device associated with the exercise equipment. The message data comprises requests associated with the exercise equipment. Each request is associated with a respective user. The requests include requests to store position data and requests to retrieve position data. In response to requests to store position data, the computing system retrieves position data for the respective user associated with the request from the request and stores the retrieved position data for the respective user associated with the request in the database. In response to requests to retrieve position data, the computing system accesses position data for the respective user associated with the request from the database, and sends the accessed position data over the computer network to the computing device.

In one aspect, exercise equipment has a frame comprising a plurality of interconnected members. A post is configured to be installed in a first member of the plurality of interconnected members and configured to be connected to a support component adapted to be physically engaged by a body part of an individual using the exercise equipment. A motor assembly includes a motor affixed to the frame and a moving member connected to the post. The moving member is configured to be moved by the motor in response to a drive signal input to the motor assembly to move the post along the first member with a range of motion between a first position and a second position. A sensor is configured to sense a current position of the moving member along the range of motion and having an output providing a signal indicative of the current position. A computing device includes computer program instructions that configure the computing device. The computing device receives data based on the signal indicative of the current position of the post and stores, in computer storage, the received data as a respective position for that ergonomic feature for the user.

In one aspect, a computing device for exercise equipment includes a processing system comprising a processing unit, computer storage, and computer program instructions that, when processed by the processing unit, configure the processing system. The configured processing system receives data based on a signal from a sensor of the exercise equipment indicative of a current position of the adjustable ergonomic feature, and, in response to an instruction from a user, stores, in computer storage, data indicative of the current position as a respective setting for the position of the ergonomic feature for the user.

In one aspect, an exercise system can be used by a plurality of individuals. The exercise system includes a first exercise device and a second exercise device. The first exercise devices includes a first frame comprising a plurality of interconnected members. A first post is configured to be installed in a first member of the frame and configured to be connected to a first support component adapted to be physically engaged by a body part of an individual. A first motor assembly includes a first motor affixed to the first frame and a first moving member connected to the first post. The first moving member is configured to be moved by the first motor in response to a first drive signal input to the first motor assembly to move the first post along the first member with a first range of motion between a first position and a second position. A first sensor is configured to sense a current position of the first moving member along the first range of motion and has an output providing a signal indicative of the current position. A first computing device is configured to receive data describing a desired position of the first post, receive data based on the signal indicative of the current position of the first post, determine a drive amount for the first motor assembly based on at least the desired position and the current position of the first post, and output the first drive signal to the first motor assembly based on the determined drive amount. Similarly, the second exercise device includes a second frame comprising a plurality of interconnected members. A second post is configured to be installed in a second member of the second frame and is configured to be connected to a second support component adapted to be physically engaged by a body part of an individual. A second motor assembly includes a second motor affixed to the second frame and a second moving member connected to the second post. The second moving member is configured to be moved by the second motor in response to a second drive signal input to the second motor assembly to move the second post along the second member with a second range of motion between a third position and a fourth position. A second sensor is configured to sense a current position of the second moving member along the second range of motion and has an output providing a signal indicative of the current position. A second computing device is configured to receive data describing a desired position of the second post, receive data based on the signal indicative of the current position of the second post, determine a drive amount for the second motor assembly based on at least the desired position and the current position of the second post, and output the drive signal to the second motor assembly based on the determined drive amount. The exercise system further includes a server computer and a computer network interconnecting the first computing device and the second computing device to the server computer. The server computer comprises a database storing, for each individual of a plurality of individuals, respective position data for the one or more adjustable ergonomic features of the first exercise device and the second exercise device as used by the individual. The server computer is configured to be responsive to requests received from the first computing device and the second computing device, wherein each request is associated with a respective user, to access the database to store or retrieve position data for the respective user associated with the request.

Any of the foregoing can include one or more of the following features. The exercise equipment includes a user interface that receives an input from a user indicating an instruction to store current settings for a position of an ergonomic feature in computer storage in a manner associated with the user. The current settings can be stored in computer storage in the exercise equipment. The current settings can be stored in removable or wirelessly connected computer storage connected to the exercise equipment. The current settings can be stored in computer storage connected to the exercise equipment over a computer network.

Any of the foregoing can include one or more of the following features. The first member comprises a seat tube forming part of a back section of the exercise equipment. The post comprises a seat post. The exercise equipment includes the support component. The support component comprises a seat.

Any of the foregoing can include one or more of the following features. The first member comprises a head tube forming part of a front section of the exercise equipment. The post comprises a stem for a handlebar. The exercise equipment includes the support component. The support component comprises a handlebar.

Any of the foregoing can include one or more of the following features. The exercise equipment further includes a second motor assembly. The second motor assembly includes a second motor configured to be affixed to the post. The second motor assembly includes a second moving member adapted to be connected to the bracket. The second moving member is configured to be moved by the second motor in response to a second drive signal input to the second motor assembly to move the second moving member laterally with respect to the post with a second range of motion between a third position and a fourth position. A second sensor is configured to sense a second current position of the second moving member along the second range of motion and having an output providing a signal indicative of the second current position. The second range of motion comprises an angular range of motion. The second range of motion comprises a linear range of motion.

Any of the foregoing aspects may be embodied as a computer system, as any individual component of such a computer system, as a process performed by such a computer system or any individual component of such a computer system, or as an article of manufacture including computer storage in which computer program code is stored and which, when processed by the processing system(s) of one or more computers, configures the processing system(s) of the one or more computers to provide such a computer system or individual component of such a computer system.

The following Detailed Description references the accompanying drawings which form a part this application, and which show, by way of illustration, specific example implementations. Other implementations may be made without departing from the scope of the disclosure.

DETAILED DESCRIPTION

Figure 1:
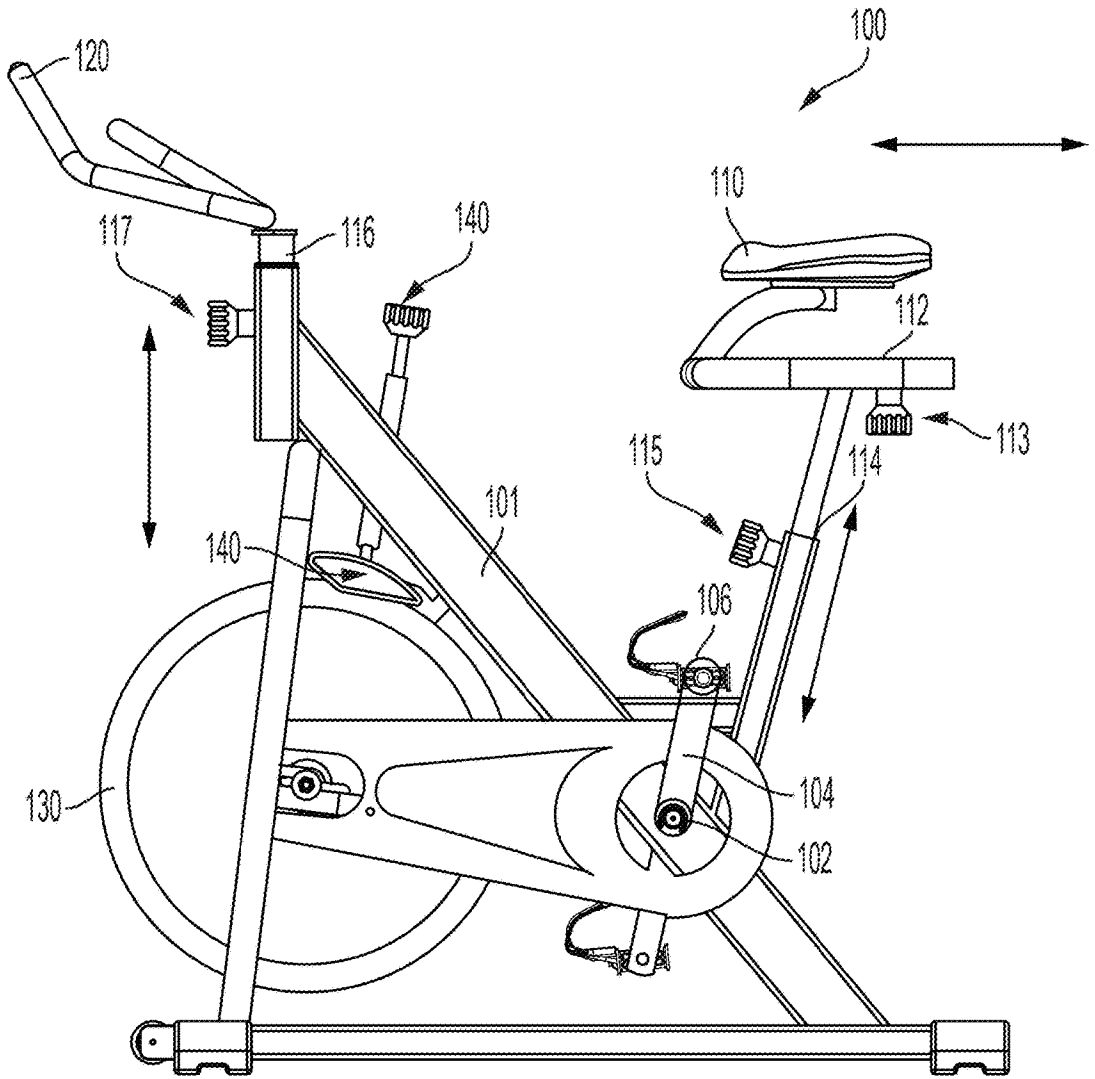
FIG. 1 PRIOR ART
FIG. 1 is a schematic illustration of a typical construction for a conventional exercise cycle.

Referring now to FIG. 1, a typical exercise cycle will first be described. The exercise cycle 100 has a frame 101 which supports mechanical elements of the cycle and support structures for a rider. The exercise cycle 100 has a crankshaft 102 connected to the frame. Crank arms 104, to which pedals 106 are connected, connect to the crankshaft 102. A rider (not shown) sits on a seat 110, places their feet on the pedals 106, and moves their legs in a circular motion with the pedals. Typically the rider places hands or arms or both on handlebars 120. The rotary motion of the crankshaft 102 in response to the rider moving the pedals 106 engages with some form of mechanical resistance. In the example shown in FIG. 1, the mechanical resistance is provided by a wheel 130 connected to a gear (not shown) which is mechanically attached to the crankshaft through a chain, belt, gear-driven mechanism or other device (not shown). A resistance, typically adjustable, is applied through some mechanism, to resist rotation of the crankshaft. Such a resistance may be mechanical, electrical, electromagnetic or other type. In the example of FIG. 1, for example, a resistance can be applied to the wheel as shown at 140.

The typical exercise cycle 100 further includes mechanical elements that allow the position of the seat 110 to be changed relative to the position of the crankshaft 102, and in turn the pedals 106. Also, most exercise cycles also have mechanical elements that allow the position of the handlebars to be changed relative to the frame 101. In the example exercise cycle of FIG. 1, a sliding mechanism 112 is provided to allow forward and backward positioning of the seat relative to the frame 101. An adjustment knob 113 allows this sliding mechanism to be secured in place. Similarly, a sliding mechanism 114 is provided to allow vertical positioning of the seat relative to the frame 101. An adjustment knob 115 allows this sliding mechanism to be secured in place. Some exercise equipment further allow the seat to be rotated to adjust the tilt of the seat (not shown). In the example shown in FIG. 1, another sliding mechanism 116 is provided to allow vertical positioning of the handlebar relative to the frame. An adjustment knob 117 allows this sliding mechanism to be a secured in place. Adjustment knobs 113, 115, and 117 typically are implemented using a spring loaded pin that registers into a hole in the frame and one of multiple holes at different positions in a post engaging the frame. Some cycles further allow the handlebars to be adjusted in a forward and backward position horizontally (not shown). Some exercise cycles further allow the handlebars to be rotated to adjust the tilt of the handlebars (not shown).

As should be evident from FIG. 1, each individual that uses the exercise cycle 100 must adjust the seat height and horizontal position and the handlebar position for each use. Between uses by different individuals, the seat position and handlebar position likely will be changed. For example, different members of a household may use the same exercise cycle and need to adjust the positions. As another example, at a gym an exercise cycle may be used by many different people. Also, the gym may have many exercise cycles and an individual probably will not use the same exercise cycle at each visit.

Figure 2:
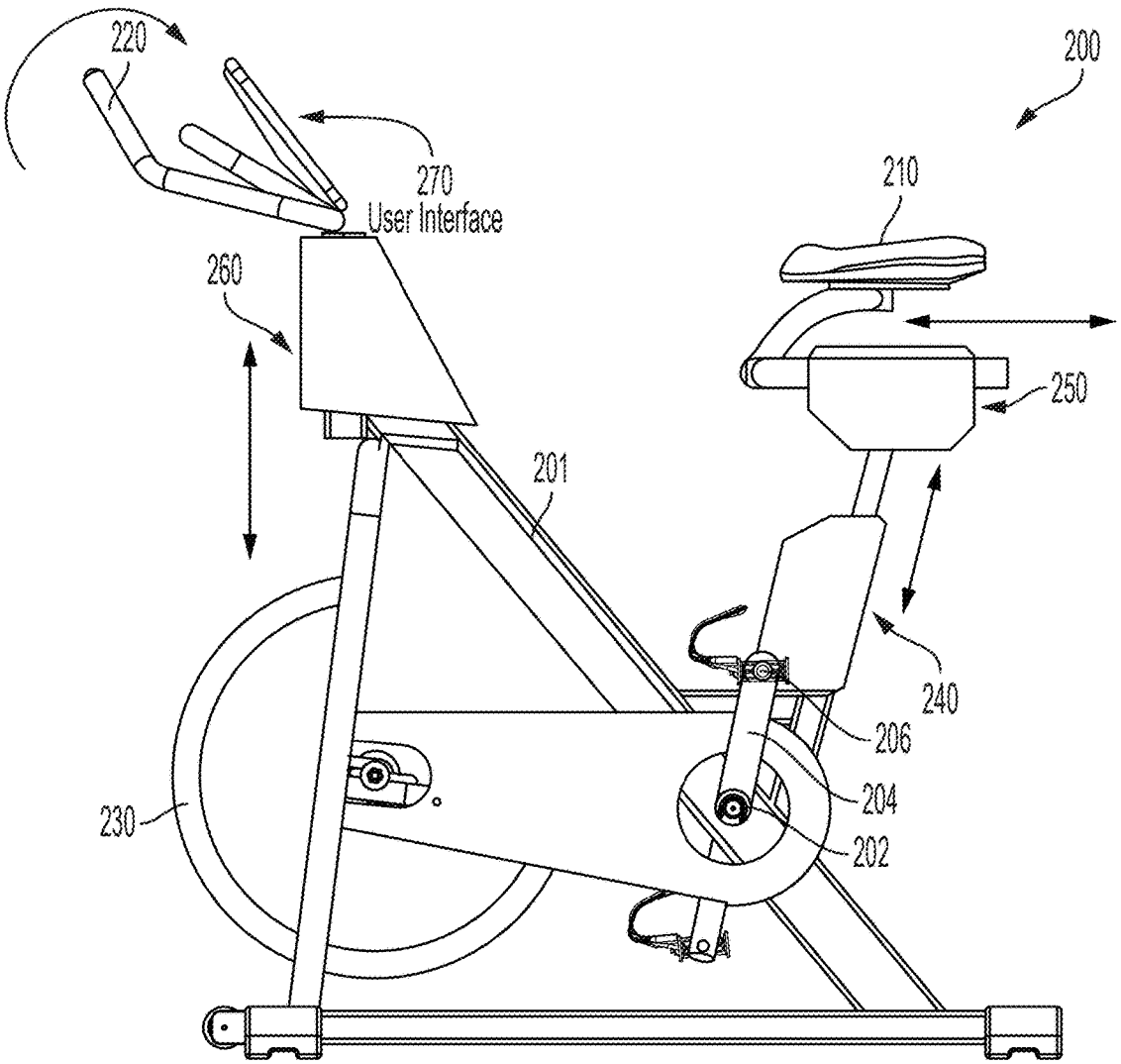
FIG. 2 is a schematic illustration of a construction for an exercise cycle having electromechanically controlled rider position settings.

Turning now to FIG. 2, a schematic illustration of an example exercise cycle having electromechanically controlled rider positions will now be described. Similar to the exercise cycle shown in FIG. 1, this exercise cycle 200 has a frame 201 which supports mechanical elements of the cycle and support structures for a rider. The exercise cycle 200 has a crankshaft 202 connected to the frame. Crank arms 204, to which pedals 206 are connected, connect to the crankshaft 202. This exercise cycle also has handlebars 220. A rider operates the cycle in essentially the same manner. In the example shown in FIG. 2, a wheel 230 is connected to a gear (not shown) which is attached to the crankshaft through a chain, belt, gear-driven mechanism, or other device (not shown), to which some resistance can be applied in any conventional manner (not shown). Such a resistance may be mechanical, electrical, electromagnetic or other type.

The exercise cycle 200 further includes electromechanical elements 240 that allow the vertical position of the seat 210 to be changed relative to the position of the crankshaft 202, and in turn the pedals 206. The exercise cycle 200 further includes electromechanical elements 250 that allow the horizontal position of the seat 210 to be changed relative to the frame 201. Exercise cycle 200 also is illustrated as having electromechanical elements 260 that allow the position (whether vertical position, horizontal position, or rotation or tilt, or any combination of these) of the handlebars 220 to be changed relative to the frame 201. However, in some implementations, the exercise cycle might not have electromechanically adjustable handlebars and may have fixed handlebars.

As will be described in more detail below, the electromechanical elements 240, 250, 260, typically include (not shown in FIG. 2) an actuator including a motor and movable member, a sensor, control circuitry, and wiring. Through the wiring, the electromechanical element receives power and control signals from a control unit (not shown in FIG. 2) to drive the actuator, and provides sensor signals from the sensor to the control unit.

Also as described in more detail below, the exercise cycle, a user interface 270 is provided. Through the user interface 270, the control unit can, among other things, provide information related to the positions of the seat 210 and handlebars 200 to an individual or a computer or a storage device. Also, the control unit can receive information related to the positions of the seat 210 and handlebars 200 from an individual or a computer or a storage device. For example, an individual can provide instructions, through the user interface, to adjust the position of seat or handlebars or both. Data related to those rider positions can be stored, for example, within the control unit, on a computer remote from the exercise cycle, or on a removable storage device, or any combination of these. When the user returns to this exercise cycle after another person has used it, or when the user uses another similar exercise cycle with such capabilities, the data related to the rider position for that individual can be recalled and used to set the positions of the seat 210 and handlebars 200.

Figure 3:
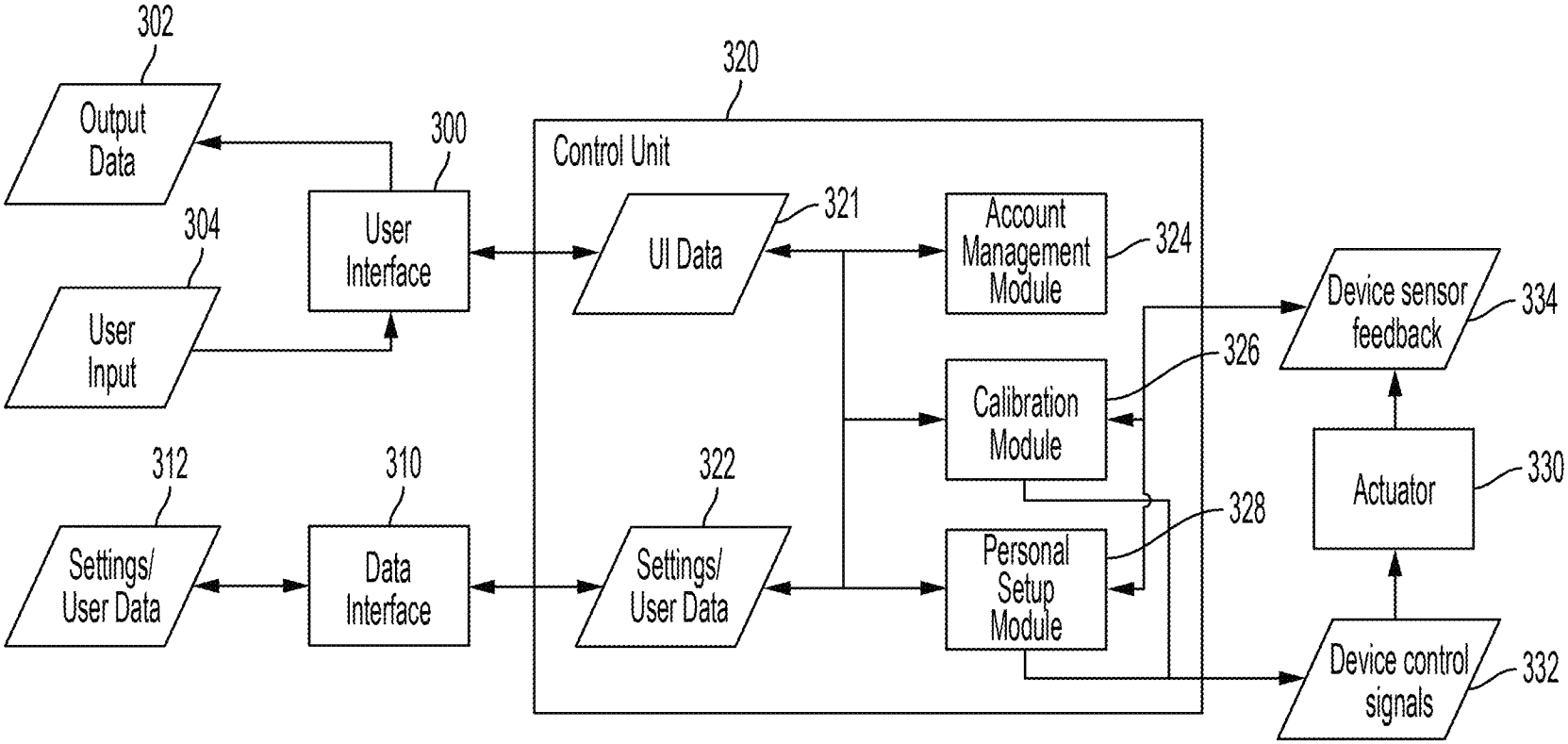
FIG. 3 is a data flow diagram illustrating the structure and function of processing for the electromechanically controlled rider position settings.

Turning now to FIG. 3, an example implementation of a controller within an exercise cycle, will now be described. The controller of the exercise cycle has a user interface 300 which includes one or more output devices (not shown) for presentation of output data 302, and one or more input devices (not shown) for receiving user input 304 from an individual. Example output devices include but are not limited to a video display, one or more LED displays, a speaker, one or more jacks for headphones, a touch screen, or any combination of these. Example input devices include but are not limited to one or more buttons, a microphone, a touchscreen, or other electromechanical devices such as knobs and switches, Or any combination of these.

The controller of the exercise cycle also includes a data interface 310 for communication of settings and other user data 312 with external computing or storage devices. Example external computing devices include but are not limited to an individual's mobile device (such as a watch or phone) or tablet computer, or a remote computer system, or any combinations of these. Example external storage devices include but are not limited to a USB storage device, RFID tag or token, or any other wirelessly connected storage (such as by using a WiFi, Bluetooth, or RFID connection). The data interface 310 can include one or more of, for example, a bluetooth interface, WiFi, RFID, or other wireless interface, a USB interface or other similar mechanical interface, or a network interface, such as an Ethernet connection, or any combination of these.

The data interface 310 and the user interface 300 connect to a control unit 320 for the exercise cycle. As described in more detail below in connection with FIG. 33, the control unit 320 can be implemented using a form of general purpose computer, which includes one or more computer processing devices and computer storage for storing data and computer program instructions. The computer program instructions implement functions of the control unit, such as a personal setup module 328, a calibration module 326, and account management module 324. The computer storage stores data, such as the UI data 321 and settings and user data 322, for use by modules 328, 326, and 324.

The control unit sends device control signals 332 to one or more actuators 330. Each actuator 330 is responsible for adjusting a position of a support structure for the rider relative to the frame of the exercise cycle. In the specific case of an exercise cycle, the support structure is at least a seat. Some exercise cycles may have handlebars which may be adjustable. The exercise cycle may include a respective actuator 330 for one or more of seat height, seat tilt angle, seat horizontal position, handlebar height, handlebar horizontal position, or handlebar tilt or angle. The actuator 330 provides device sensor feedback 334 to the control unit 320. Turning back to the control unit 320, the personal setup module 328 receives the previously stored settings data 322 or inputs provided by the user or another system in the user interface data 321. In response to such inputs, the personal setup module sends device control signals 332 to the actuator 330. The control signals 332 cause the motor of the actuator to be driven to adjust the position of the corresponding support structure. The personal setup module receives the device sensor feedback 334. As described in more detail below, in one mode of operation, the personal setup module 328 drives the actuator 330 until the device sensor feedback 334 indicates that the support structure has been moved to a desired position, for example, a position indicated by the settings 322. In another mode of operation, the personal setup module 328 drives the actuator 330 according to input from the user, using the user interface data 321. The user input can be manual positioning (driving the elements into position one step at a time), numerical (setting to a known numerical position), or user physical size data such as height, inseam, arm length, etc. If a user enters their physical measurements, the system could use the data to suggest a starting point for ideal fit. There could also be a mode where the user enters position data related to another manufacturer's equipment and the system is able to convert the data to the equivalent positions for the equipment in use. It should also be noted that a single user may have saved multiple sets of settings (or profiles).

The calibration module 326 positions a support structure of the exercise cycle in the context of calibrating an actuator 330. The calibration operations depend on the type of actuator, sensor, and other mechanical elements. For example, in some systems, the sensor provides a relative position. With a relative position, the actuator is first "homed" at a power-on cycle to establish a "zero" position. After homing, the system can to drive the elements to known positions relative to the zero position. In some systems, the sensor provides absolute position data and a factory calibration establishes known positions. The actuator can be driven to desired positions without homing at power-on.

The account management module 324 implements conventional functionality for authenticating a user, collecting personal information about the user, and tracking usage and other transactions for the user. The account management module includes functions for receiving instructions from the user regarding the user's settings for the exercise cycle, such as to upload (e.g., from a storage device or a remote computer), store (e.g., to a storage device or a remote computer), update, delete, or display such information. The account management module includes functions for communicating with the individual using the UI data 321 through the user interface 300. The account management module includes functions for communicating settings and user data 322 to and from a storage device or remote computer system through the data interface 310.

Figure 4:
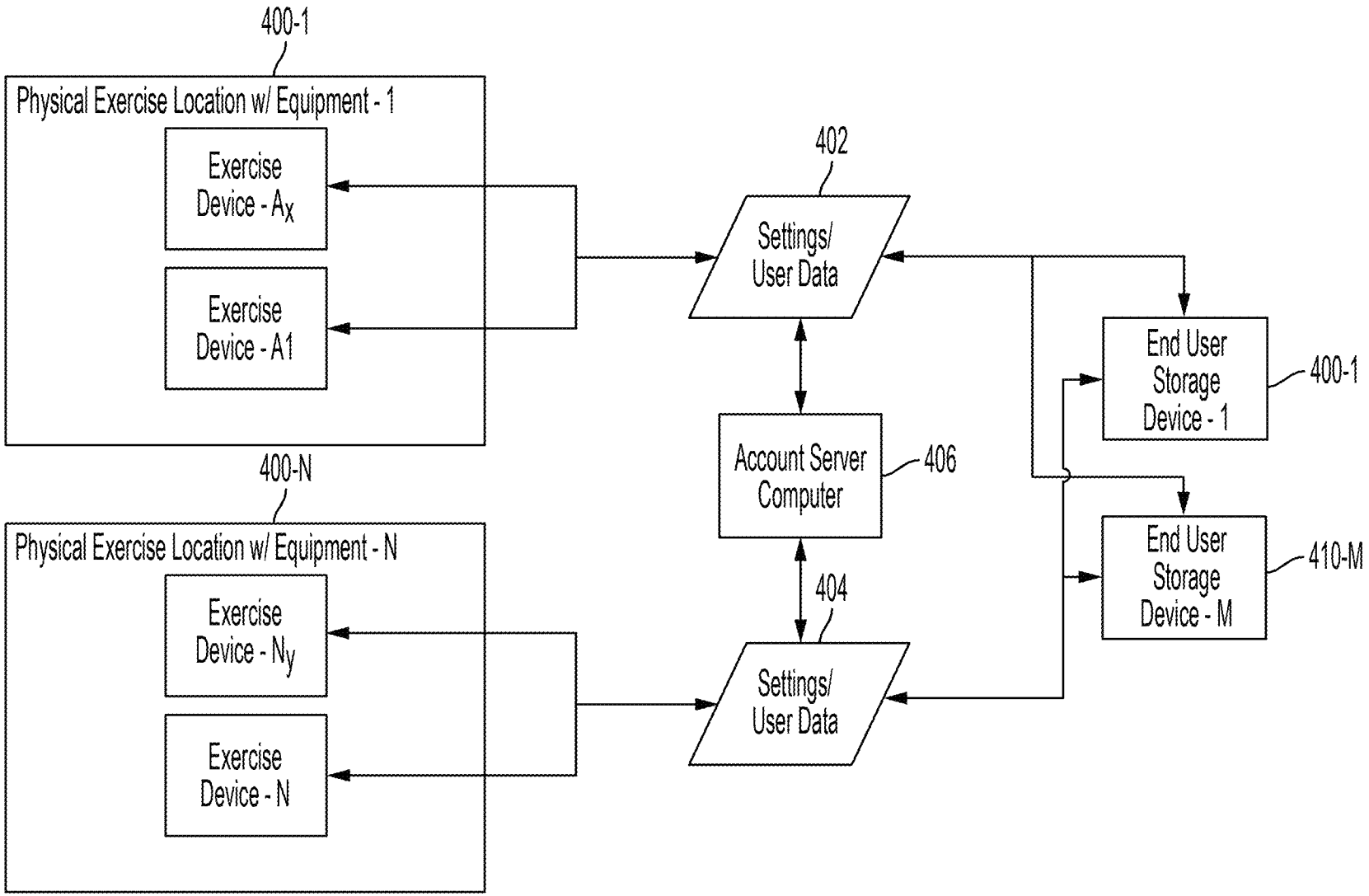
FIG. 4 is a data flow diagram illustrating an example set up of a system with multiple exercise devices and multiple users.

Turning now to FIG. 4, a data flow diagram illustrating an example system arrangement with multiple exercise devices in multiple exercise locations with multiple users will now be described. As illustrated in FIG. 4, there may be one or more locations 400-1, . . . , 400-N, each having a respective collection of one or more exercise devices A1, . . . , Ax, . . . , and N1, . . . . Ny (N, x, and y are respectively integers greater than or equal to 1). Each one of the exercise devices can communicate settings and other user data as indicated at 402 and 404 with a central server computer 406. Such a server computer can be maintained, for example, by a service provider that provides access to the exercise equipment as a service. Also, each end user can have a respective end user storage device, 410-1, . . . , 410-M, wherein M is an integer greater than or equal to 1 and corresponding to the number of end users. Each one of the end user storage devices can communicate the respective user's settings and other user data as indicated at 402 and 404 with the central server computer 406 and with one of the exercise devices during use of that exercise device.

Figure 5:
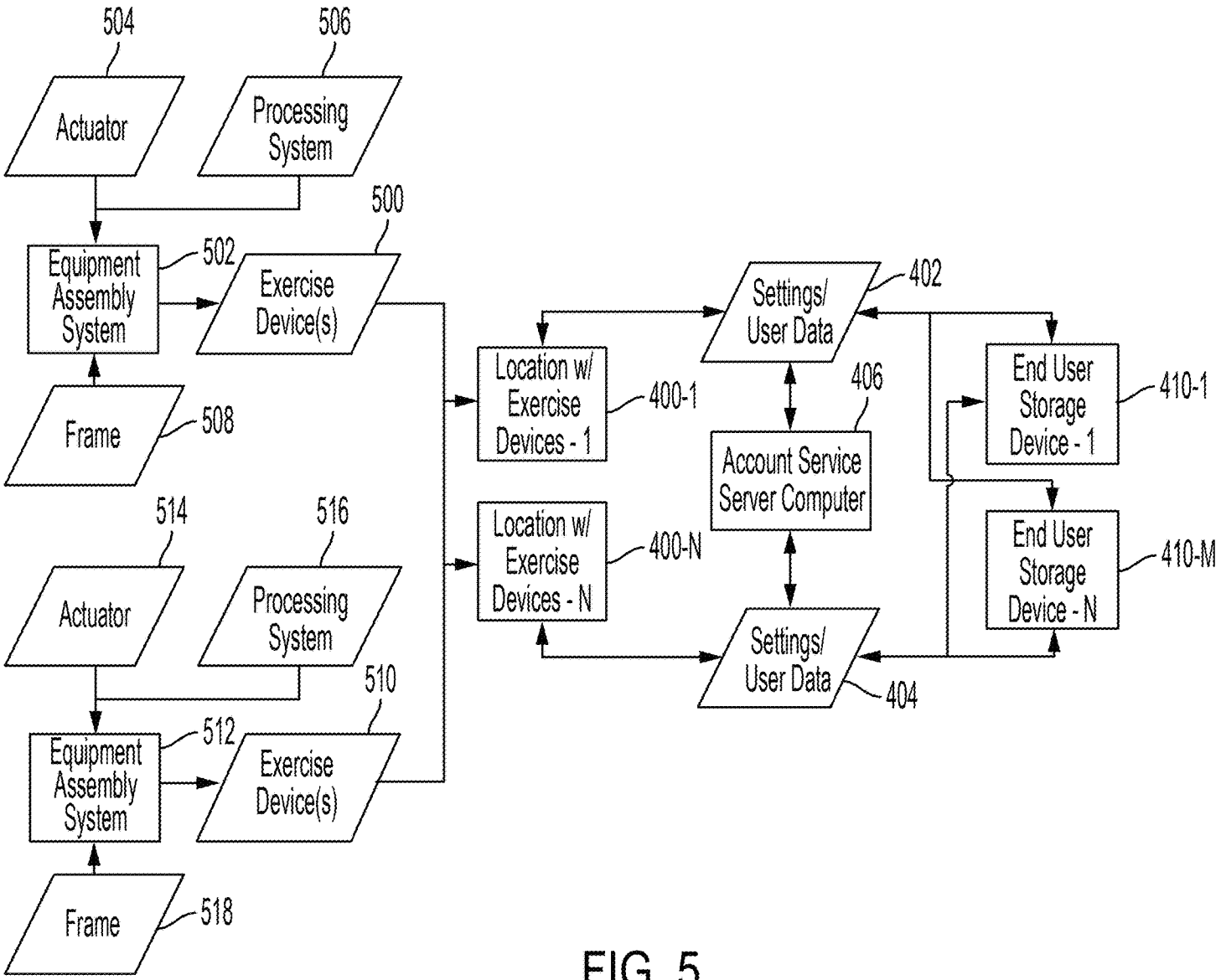
FIG. 5 is a data flow diagram illustrating an example system using multiple types of exercise devices.

FIG. 5 illustrates the elements of FIG. 4 with the addition of the supply of the exercise device(s) 500 and 512 from manufacturers. It is conceivable that distinct types of exercise devices 500, 510 may be provided by different equipment assembly systems 502, 512 used by different manufacturers. For example, a first manufacturer may use equipment assembly systems 502 to combine actuators 504, a processing system 506, and a frame 508 (among other components) to produce exercise device(s) 500. A second manufacturer may use equipment assembly system 512 to combine actuators 514, a processing system 516, and a frame 518 (among other components) to produce exercise device(s) 510. The frames, actuators, and processing systems, among other items, used by different manufacturers may be distinct and different from each other, resulting in different exercise devices with different performance and different ways to control the positions of ergonomic features. Locations 400-1 to 400-N which purchase such exercise devices 500, 510 may include a heterogeneous set of exercise devices from different manufacturers. The processing systems within these exercise devices, or the account service server computer 406, can be programmed to store or process settings and user data from multiple end users.

Given such a system as described in FIGS. 1 through 5, when a user logs into the system to use an exercise device, the control unit for the exercise device retrieves the user's saved settings, such as from a local memory, a central server computer over a computer network, or a removable storage device or mobile device belonging to the user. The control unit drives the actuators, which are responsible for physically moving the seat and handlebars, through a feedback control system within the control unit that compares positional data from sensors to the targeted position values provided by the user's account. Positional adjustments may include the user's preferred seat height and lateral position, as well as the height and angle of the handlebars. The positioning system accommodates multiple users. For example, on shared exercise equipment such as that of a public gym, each user can save their preferences to an account, and the control unit can switch between settings depending on the user's login credentials.

Various mechanisms can be employed in the adjustable elements of the exercise cycle. The following are some examples. It should be understood that the following illustrations are schematic in nature and not size to fit any particular exercise device. The relative sizes of their components, materials, and manner and placement of connection to the exercise device frame and adjustable components are subject to numerous design criteria and will vary from device to device.

Figure 6:
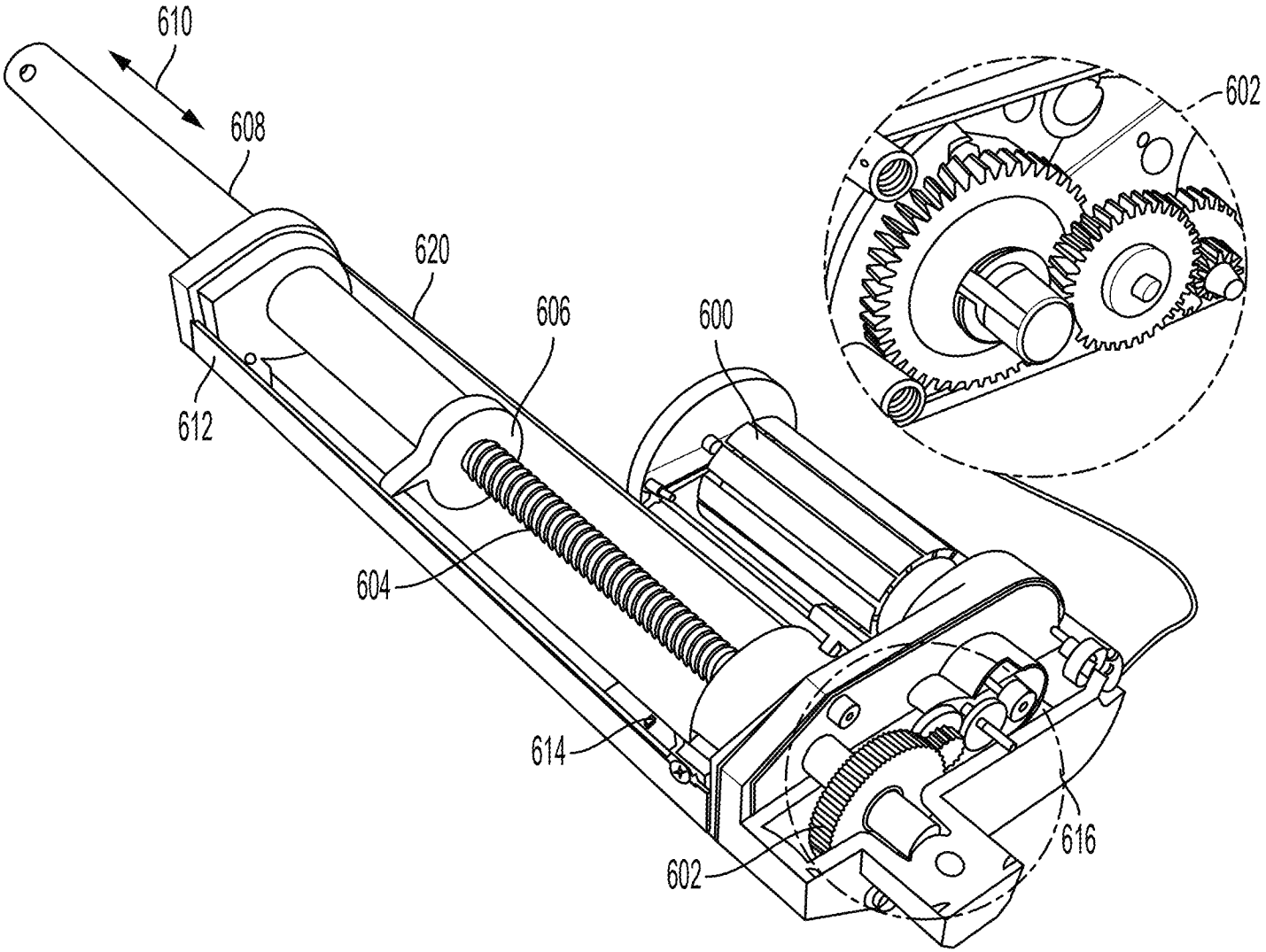
FIG. 6 is a perspective view of an example linear actuator.

FIG. 6 illustrates an example linear actuator. A linear actuator is useful for controlling movement of one member relative to another along a line. For example, a linear actuator can be used to adjust the height of a seat or a handlebar relative to a cycle frame. An example of a commercially available linear actuator is the Model FA-240-S-12-18 linear actuator from Firgelli Automotive. This model can support 200 pounds, has an 18" stroke, and requires a power source of 12 volts with direct current.

A linear actuator includes a motor 600 that drives one or more gears 602. The one or more gears rotate a lead screw 604. A leadscrew nut 606 changes its position on the lead screw 606 as the lead screw rotates. The lead screw nut 606 is connected to a shaft 608 which moves along the direction indicated by arrows 610. In this example, the linear actuator includes an extend limit switch 612 and a retract limit switch 614 which prevent the actuator from extending or retracting beyond these switches. The linear actuator shown in FIG. 6 includes a gearbox 616 houses the one or more gears of the gearing system 602. The lead screw 604, lead screw nut 606, shaft 608, and switches 612 and 614 are enclosed within a housing 620.

For a cycle, the housing 620 and gearbox 616 are connected to or form a part of the frame 200 of the cycle. The shaft 608 connects to or forms a part of a seat post or handlebar post that supports the seat or handlebars respectively. In some implementations, the frame may be built to include a linear actuator which receives a seat post. In some implementations a seat post can be made which includes a linear actuator, for which a portion housing the lead screw is inserted into a frame.

Figure 7:
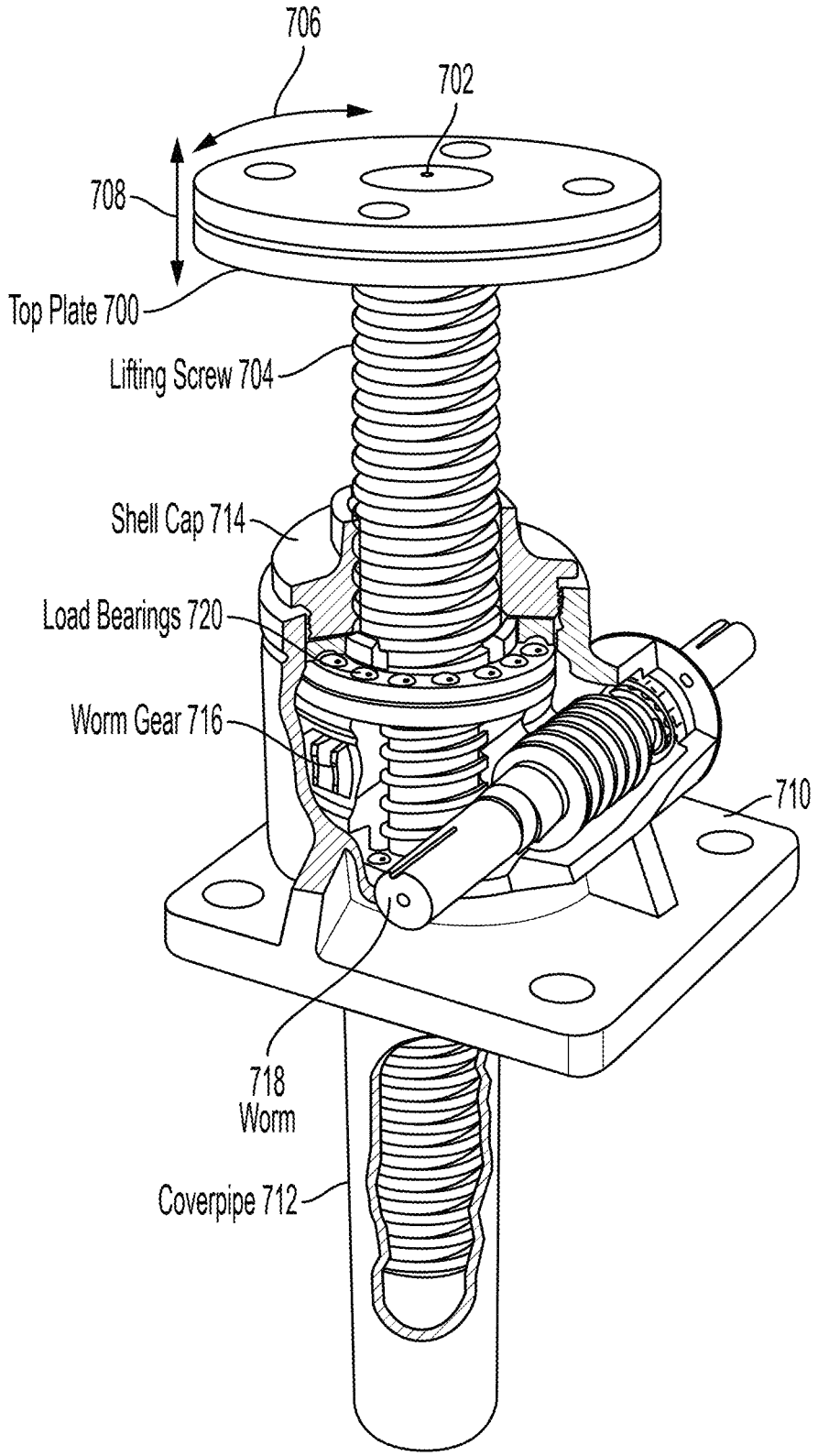
FIG. 7 is a perspective cutaway view of an example machine screw actuator.

FIG. 7 is a cutaway view, where a portion of the housing is cut away to reveal the internal components, such as an example machine screw actuator or screw jack. A machine screw actuator is useful for controlling movement of one member relative to another along a line. For example, a machine screw actuator can be used to adjust the height of a seat or a handlebar relative to a cycle frame. The machine screw actuator includes a gear which can be driven manually or under power from a motor. One advantage of a machine screw actuator is that the gear cannot be back driven. In other words, downward force on the seat or handlebars will not lower its position.

A machine screw actuator includes a top plate 700 which connects to or forms a part of a bracket supporting the cycle part for which the position is to be adjusted, such as a seat bracket (to which a seat is affixed) or handlebar bracket (to which the handlebar is affixed). The top plate 700 is secured to a lifting screw 704 using a connector 702. This connection ensures that the top plate 700 can freely rotate about the lifting screw 704 as indicated at 706, but remains at the end of the lifting screw, limiting movement with respect to the lifting screw as the lifting screw rotates. A cover bracket 710, cover pipe 712 and shell cap 714 enclose a worm gear 716. The worm gear 716 rotates the lifting screw 704 in response to rotation of a "worm" 718. A set of load bearings 720 can be placed between the worm gear 716 and the shell cap 714. The machine screw actuator shown in FIG. 7 can include a gearbox (not shown) which houses one or more gears of a gearing system (not shown), which, in response to a motor (not shown) rotates the worm 718.

For a cycle, the coverpipe 712 forms a part of the frame 200 of the cycle. The top plate 700 connects to or forms a part of a bracket or seat post or handlebar post that supports the seat or handlebars. The gearbox housing provides mounting points (flanges in the example shown) to fix the assembly to the bike frame. In some implementations the frame may be built to include a machine screw actuator which receives a seat post or forms a seat post to which a seat may be affixed. In some implementations a seat post can be made which includes a machine screw actuator which is in turn inserted into the cycle frame (such as by inserting the cover pipe into the frame).

Figure 8:
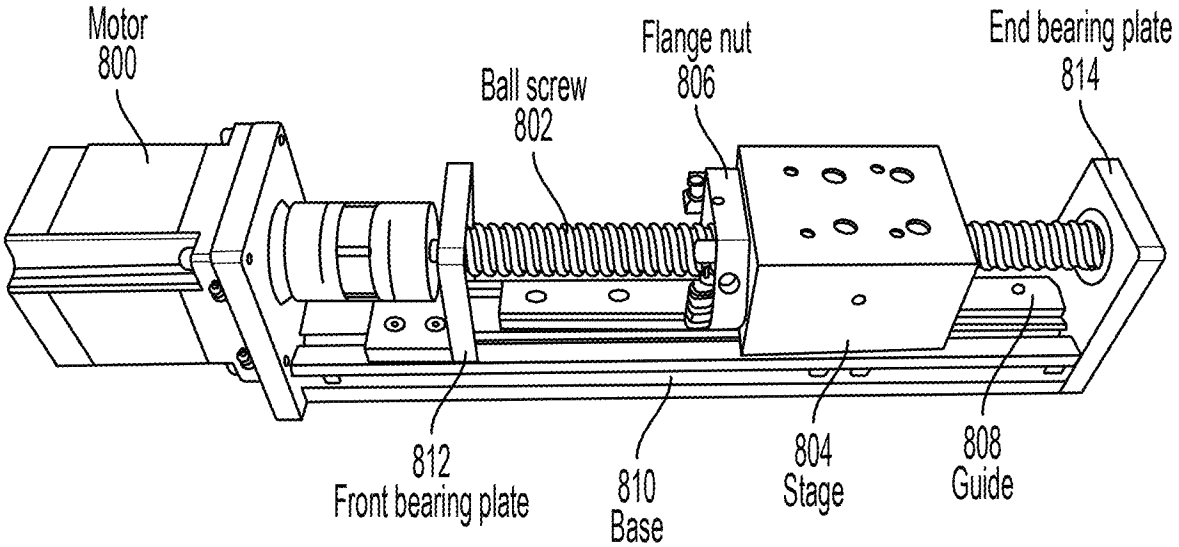
FIG. 8 is a perspective view of a first example linear stage.
Figure 9:
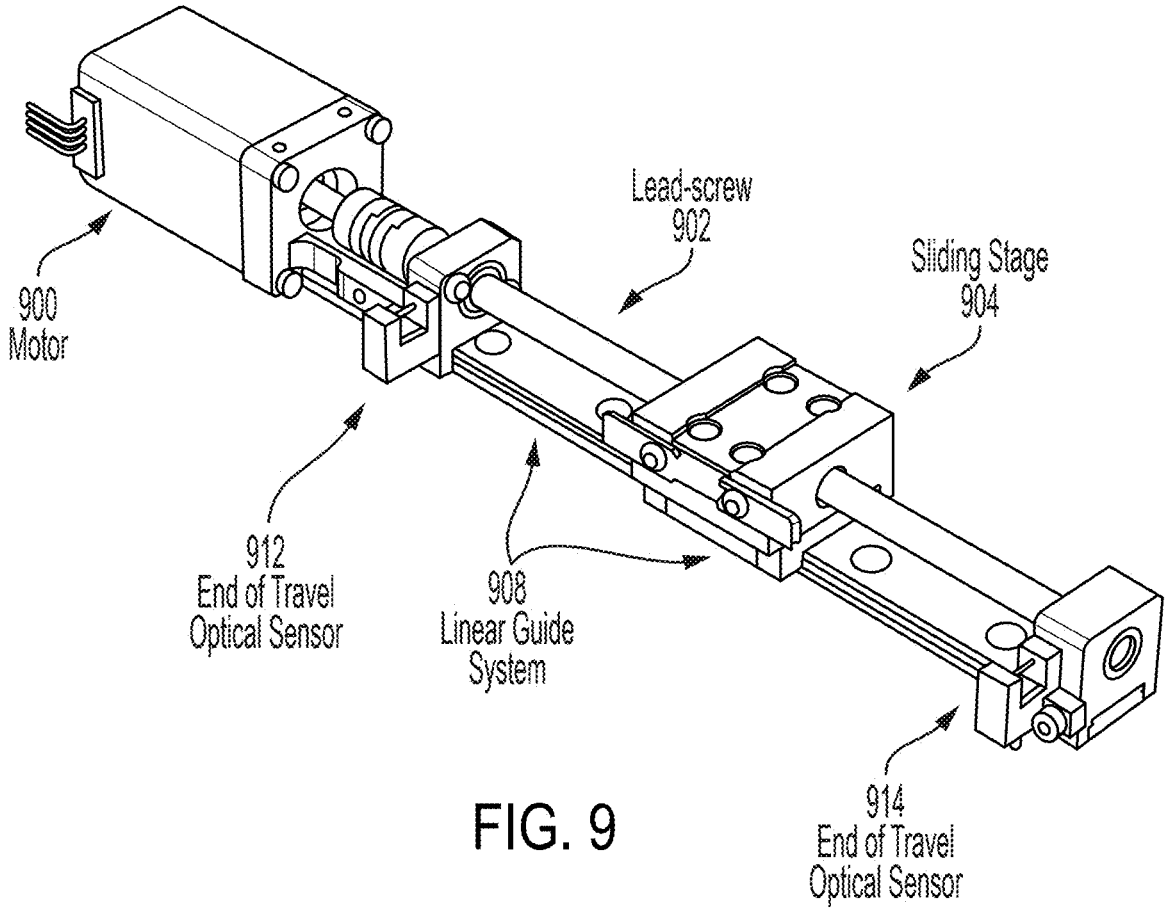
FIG. 9 is a perspective view of a second example linear stage.

FIGS. 8 and 9 illustrate example linear stage actuators. A linear stage actuator is useful for controlling movement of one member relative to another member within a fixed volume. Thus, a linear stage actuator is particularly useful to adjust the horizontal position of a seat or a handlebar relative to a cycle frame, but also may be used to adjust position of any element along a linear path, such as the vertical position of a seat post.

A linear stage actuator (as in FIG. 8) includes a motor 800 which drives a ball screw 802. A sliding stage 804 is affixed to a threaded flange nut 806. The sliding stage 804 connects to or forms a part of a bracket supporting the cycle part for which the position is to be adjusted, such as a seat bracket (to which a seat is affixed) or handlebar bracket (to which the handlebar is affixed). The flange nut 806 engages the ball screw 802. As the ball screw 802 rotates in response to the motor, the sliding stage 804, in turn, changes its position relative to the ball screw 802. The stage 804 can engage a guide 808 formed in a base 810 or other chassis supporting the motor, ball screw, and stage. A front bearing plate 812 and an end bearing plate 814 limit the extent of motion of the stage 804. Additional limit switches (not shown) can be provided to prevent the motor from driving the stage 804 when the stage has reached one of the limits.

Similarly, in FIG. 9, a motor 900 drives a lead screw 902. The motor 900 can be a stepper motor, brushed motor, brushless motor, or other type of motor. A sliding stage 904 engages the lead screw 902 through an internal threaded nut (not shown). The sliding stage 904 connects to or forms a part of a bracket supporting the cycle part for which the position is to be adjusted, such as a seat bracket (to which a seat is affixed) or handlebar bracket (to which the handlebar is affixed). As the lead screw 902 rotates in response to the motor, the sliding stage 904, in turn, changes its position relative to the lead screw 902. The sliding stage 904 engages a linear guide system 908 formed in a base 910 or other chassis supporting the motor, lead screw, and stage. Limit switches 912 and 914 can be provided to prevent the motor from driving the stage 904 when the stage has reached one of the limits.

For a cycle, the base 810 or 910 or other chassis is affixed to or forms a part of a post (which also may be vertically adjustable using another actuator) which supports the seat or handlebars, and the sliding stage 804 or 904 is affixed to or forms a part of a bracket to which the seat or handlebars is attached. In some implementations a seat post or handlebar post may be built to include such a linear stage actuator which includes a bracket attached to the sliding stage to receive the seat or handlebars.

Figure 10:
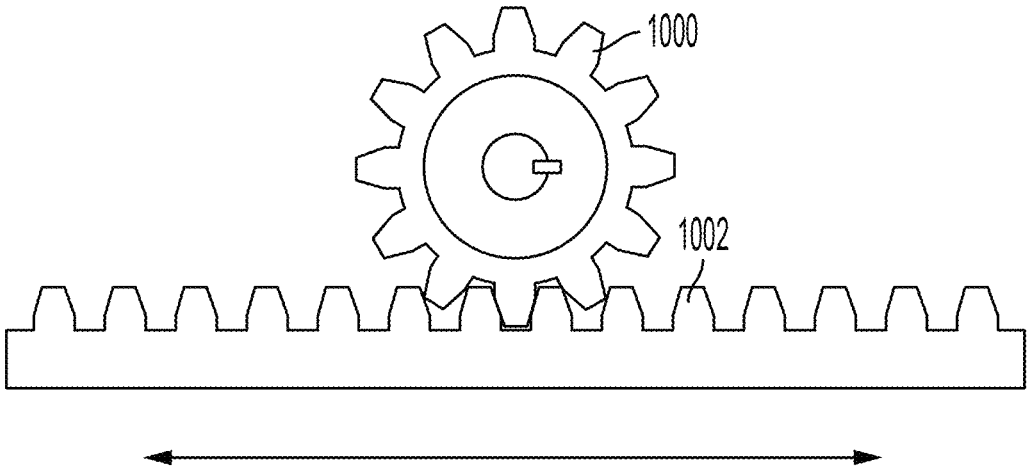
FIG. 10 is a schematic illustration of a rack and pinion device.
Figure 11:
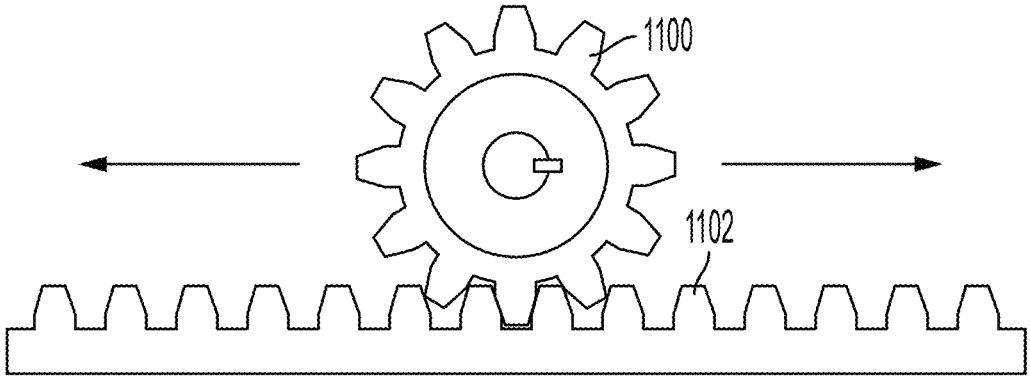
FIG. 11 is a schematic illustration of a rack and pinion device.

Another kind of electromechanical actuator that provides linear movement, a rack and pinion device, is shown in FIGS. 10 and 11. In both Figures, a motor (not shown) drives a spur gear 1000, 1100. As illustrated in FIG. 10, in response to rotation of the motor, a rack 1002 is caused to move. As illustrated in FIG. 11, the rack 1102 is fixed. Thus, in response to rotation of the motor, the component that includes the spur gear 1100 moves relative to the rack 1102.

For a cycle, a spur gear and related housing and motor can be affixed to the bike frame and the rack can be part of or affixed to a seat post or handlebar post. Alternatively, a spur gear and related housing and motor can be affixed to a seat post or handlebar post and the rack can be part of or affixed to the pick frame. Similarly, the spur gear and related housing and motor can be affixed to the seat or handlebar post, and the rack can be attached to the seat or handlebar. Alternatively, the spur gear and related housing and motor can be affixed to the seat or handlebar, and the rack can be attached to the seat or handlebar post.

Further examples of linear mechanisms include, but are not limited to, a lever arm driving a linear mechanism, a pneumatic cylinder (described in U.S. Pat. No. 10,676,146), and a hydraulic cylinder (described in PCT Publication WO 2022/220733 A1).

Given the foregoing examples of various actuators, an example implementation is to drive the linear adjustments, namely the vertical or horizontal seat positioning and that handlebar vertical positioning, using a motor-driven leadscrew, machine screw, or ball screw. U.S. Pat. Nos. 10,513,300 and 6,050,585 provide examples of the use of screw mechanisms to set the height of a cycle seat. A rack and pinion may be used for linear motion with either the rack or pinion as the fixed element of the mechanism.

A different kind of actuator is used to provide for rotational movement for pivoting elements. For example, a gearmotor, preferably of high gear ratio, such as a worm gear motor, planetary gear motor, or spur gear motor can be used.

Figure 12:
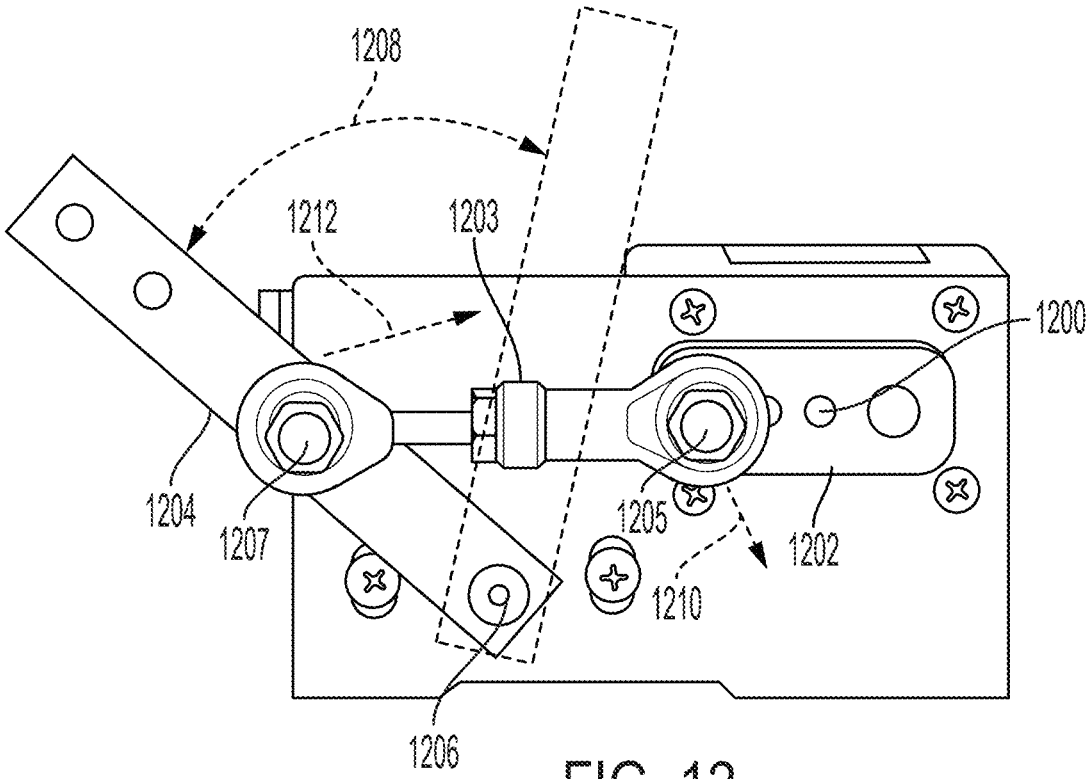
FIG. 12 is a schematic illustration of an example geared motor operating a lever arm.

Lever arms may also be used to drive pivoting elements in combination with leadscrews and other drive mechanisms. For example, as shown in FIG. 12, a shaft 1200 of a motor is attached to a first arm 1202, which in turn is rotatably connected to a second arm 1203 at a rotatable connection point 1205. Second arm 1203 is rotatably connected to a lever 1204 at connection point 1207. Lever 1204 has one end fixed at an axis 1206. When the first arm 1202 rotates (e.g., in direction 1210) in response to rotation of shaft 1200, connection point 1205 also is rotated in the same direction, causing the distal end of the second arm to be pulled and rotated (e.g., in direction 1212). The movement of the distal end of the second arm 1203 causes the lever 1204 to rotate as shown by the arrow 1208.

Figure 13:
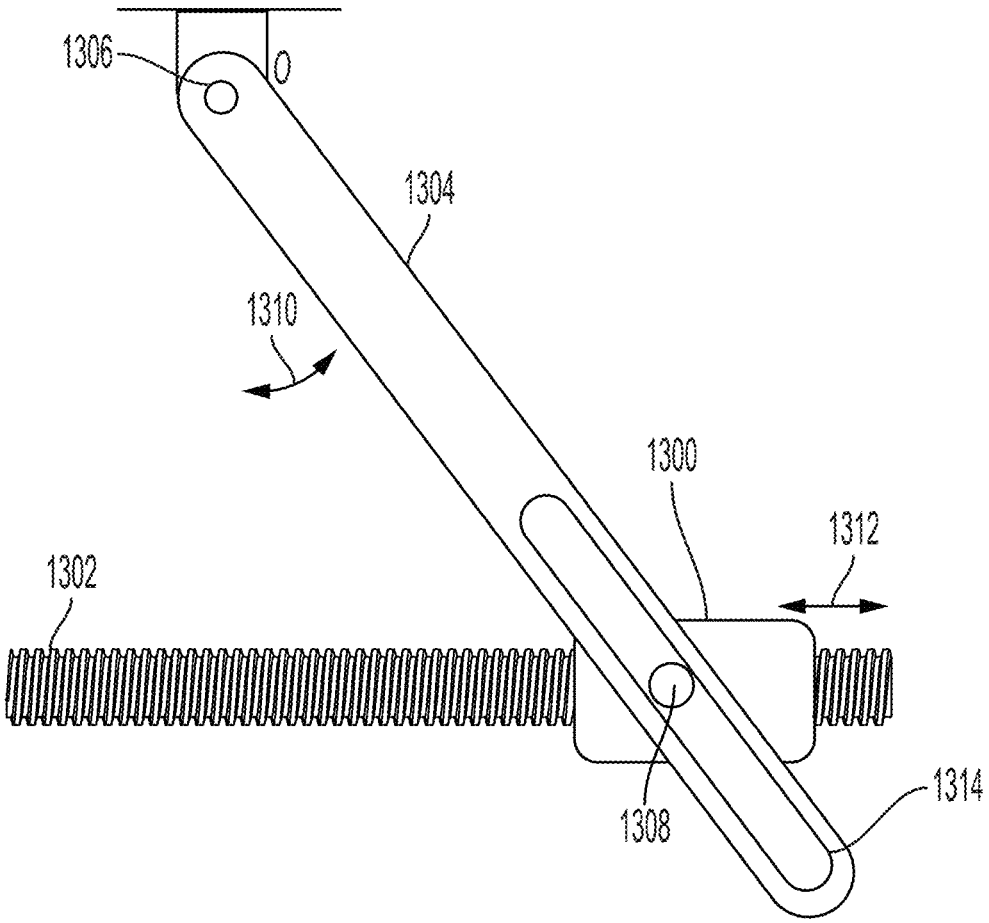
FIG. 13 is a schematic illustration of an example linear actuator operating a lever arm.

FIG. 13 illustrates a lever 1304 fixed at an axis 1306 and which rotates (along arrow 1310) in response to linear movement (along arrow 1312) of a sliding stage 1300 along a linear actuator 1302. A pin 1308 on the sliding stage 1300 slides within a slot 1314 to move the lever 1304. In FIG. 13, the actuator 1302 is shown as a drive screw, and the sliding stage 1300 is formed by a threaded nut mounted on a drive screw.

Each drive system (examples of which have been shown in FIGS. 6 through 13) is combined with a sensor. An example type of sensor that can be used is an encoder. Encoders fall into two types, linear and rotary, and two categories within each type, incremental and absolute. The majority of encoders are incremental, providing positional data as an offset from a reference point. There are a number of electromechanical technologies used in encoders: magnetic, optical, inductive, capacitive and laser. Motor driven mechanisms often use optical rotary encoders, with the encoder mounted on the motor's shaft, and many motors are manufactured with encoders built-in. Encoders can also be mounted on any shaft within a mechanism, depending on which location would provide the best system feedback. In some implementations, potentiometers can be used as sensors. For example, audio faders are linear potentiometers with variable resistance based on linear position, providing absolute position data within a constrained range of travel. In some implementations, a series of microswitches (mechanical or optical) can be employed to provide position data. For example, if an exercise bike has 10 fixed seat height positions, a series of as many as 10 (or more) microswitches can be placed within the range of system travel, which change state as the mechanism positions to each of their locations.

Each drive system (examples of which have been shown in FIGS. 6 through 13) also has a range of motion, between a first position and a second position, within which the motor can drive a support for an ergonomic feature with respect to the frame or another part of the exercise equipment, and within which the sensor can operate to detect a current position. The range of motion can include a limited set of discrete positions along this range, such as the first position, the second position, and an intermediate position. The number of possible positions along the range of motion generally is limited by the granularity of control for the motor and the granularity of sensing by the sensor.

Mechanisms that can be back-driven should incorporate position locking mechanisms. Some of the example actuators above, such as a leadscrew driven by a worm gear, may not require a locking mechanism due to the inherent mechanical advantage on the driven side of the mechanism. An example locking mechanism is a solenoid driven gear interrupter described in U.S. Pat. No. 11,680,426.

A specific example of an exercise cycle outfitted with electromechanically controlled ergonomic features will now be described in connection with FIGS. 14 through 28.

Figure 15:
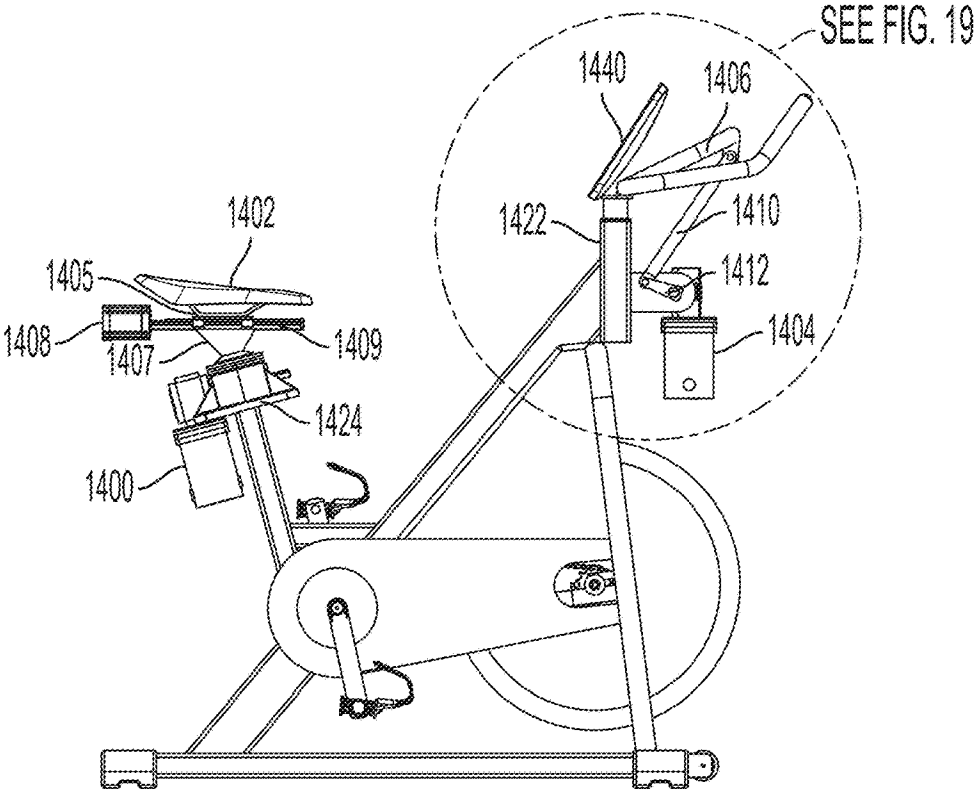
FIG. 15 is a side plan view of the exercise device of FIG. 14.
Figure 14:
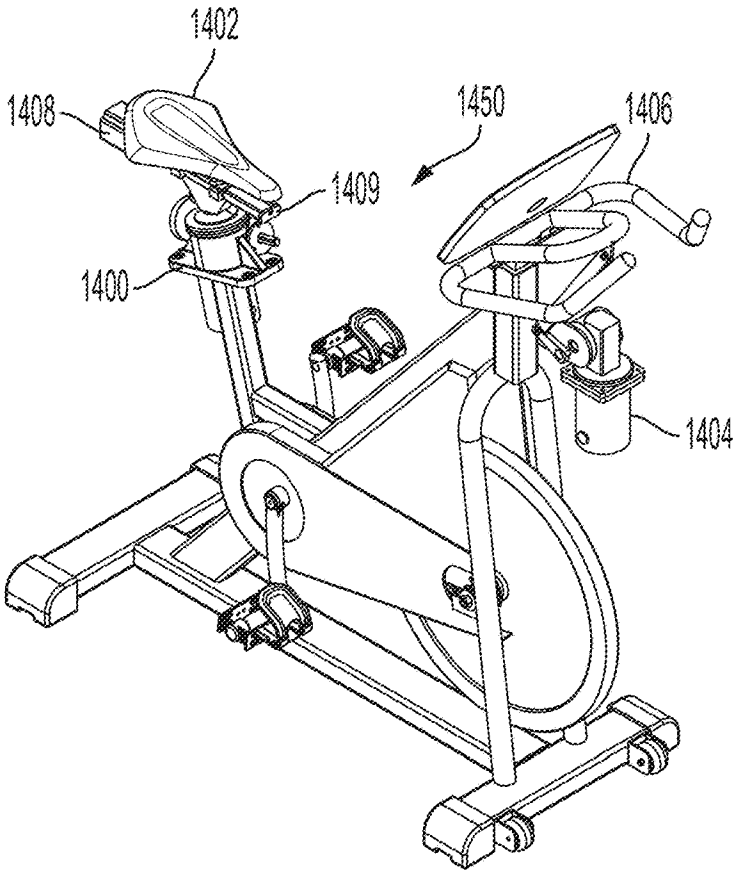
FIG. 14 is a perspective view of an example exercise device.
Figure 18:
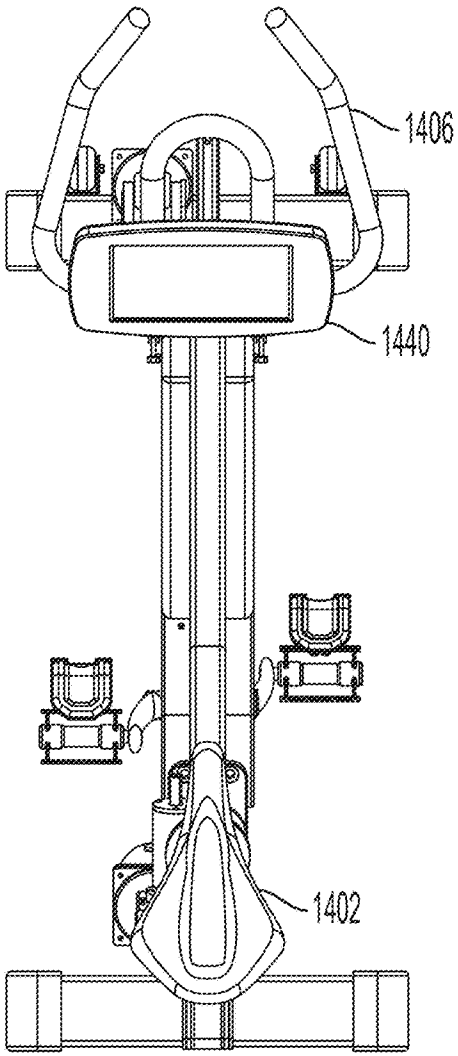
FIG. 18 is a top plan view of the exercise device of FIG. 14.
Figure 17:
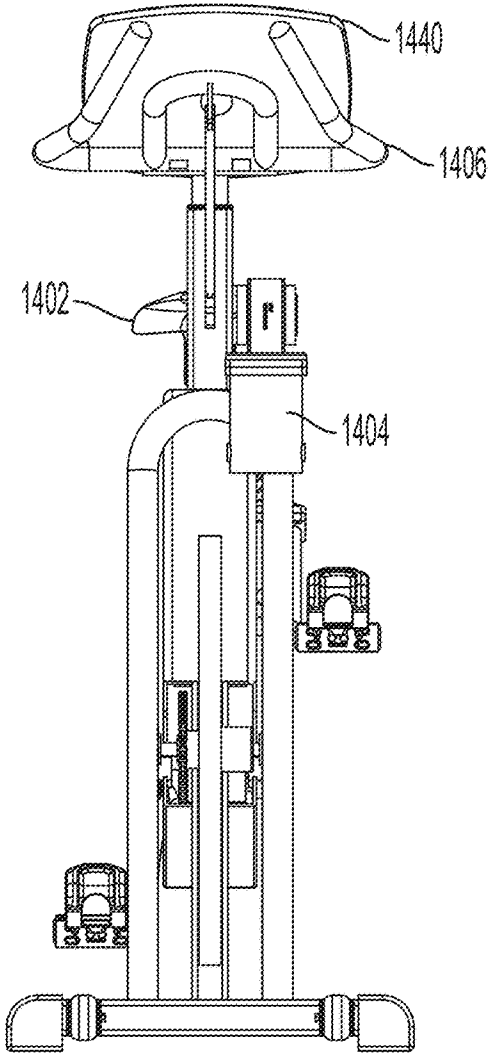
FIG. 17 is a front plan view of the exercise device of FIG. 14.
Figure 16:
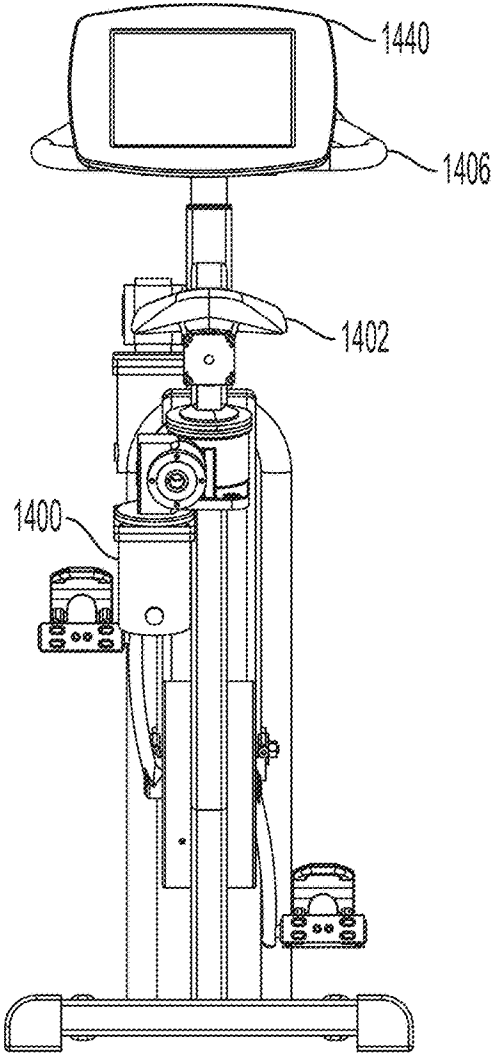
FIG. 16 is a rear plan view of the exercise device of FIG. 14.

FIG. 14 is a perspective view of an example exercise device. FIG. 15 is a side plan view of the exercise device of FIG. 14. FIG. 16 is a rear plan view of the exercise device of FIG. 14. FIG. 17 is a front plan view of the exercise device of FIG. 14. FIG. 18 is a top plan view of the exercise device of FIG. 14. In these Figures, identical reference numbers indicate identical elements, but as illustrated from different views.

In this example, an exercise cycle 1450 includes an adjustable seat 1402 and adjustable handlebars 1406. A motor assembly 1400 is mounted to the frame at 1424. The motor assembly moves the seat in a direction co-axial with the seat tube. A bracket 1407 supports a second adjustable element that includes a motor assembly 1408 with a rail 1409. The seat 1402 is mounted on a movable bracket 1405 that rides on the rail 1409 in response to the motor assembly 1408. A user interface device 1440 houses input and output devices and a computing device, which can be implemented using a form of general purpose computer.

Figure 19:
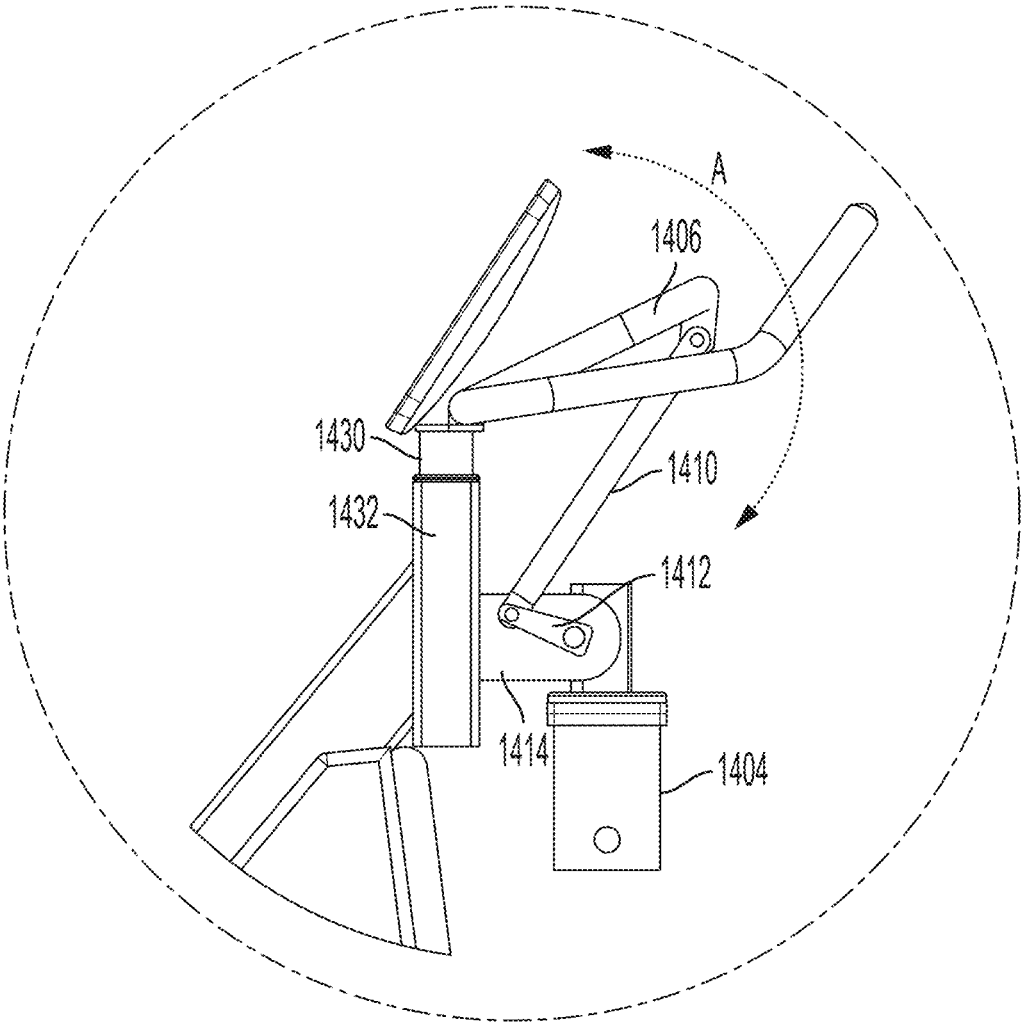
FIG. 19 is a side plan view of a detail portion of FIG. 15.

FIG. 19 is a detail view of a portion of FIG. 15, illustrating an example handlebar configuration. In FIGS. 14 through 19, a motor assembly 1404 controls motion of the handlebar 1406 radially along an arc "A" in relation to its point of attachment on stem 1430. Also, the motor assembly 1404 includes a motor (not shown), which may be implemented using a motor similar to the motor shown in FIG. 12 or FIG. 13. The motor drives arm 1412, which is pivotably connected to arm 1410, which in turn is pivotably connected to the handlebar 1406. Arm 1412 is affixed to motor assembly 1404, which is affixed to frame section 1414 which is affixed to head tube 1432. The handlebar 1406 also is pivotably connected to the stem 1430. With the stem 1430, head tube 1432 and frame section 1414 in fixed positions, and the handlebar 1406 pivotably attached to the stem 1430 and arm 1410, motion of arm 1412 changes the angle of handlebar 1406 with respect to the head tube 1432.

Figure 20:
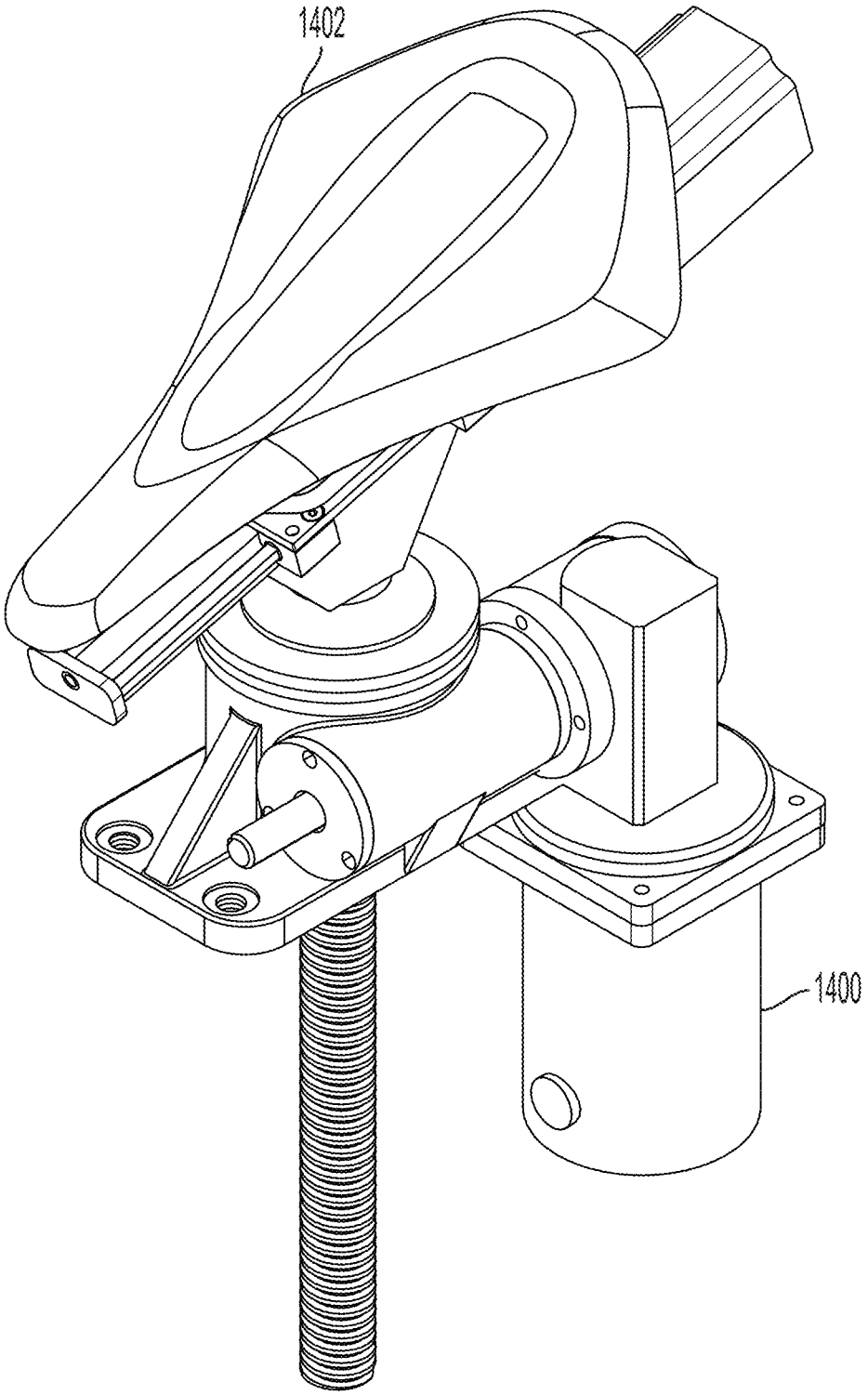
FIG. 20 is a perspective view of an example configuration of a seat for an exercise device.
Figure 21:
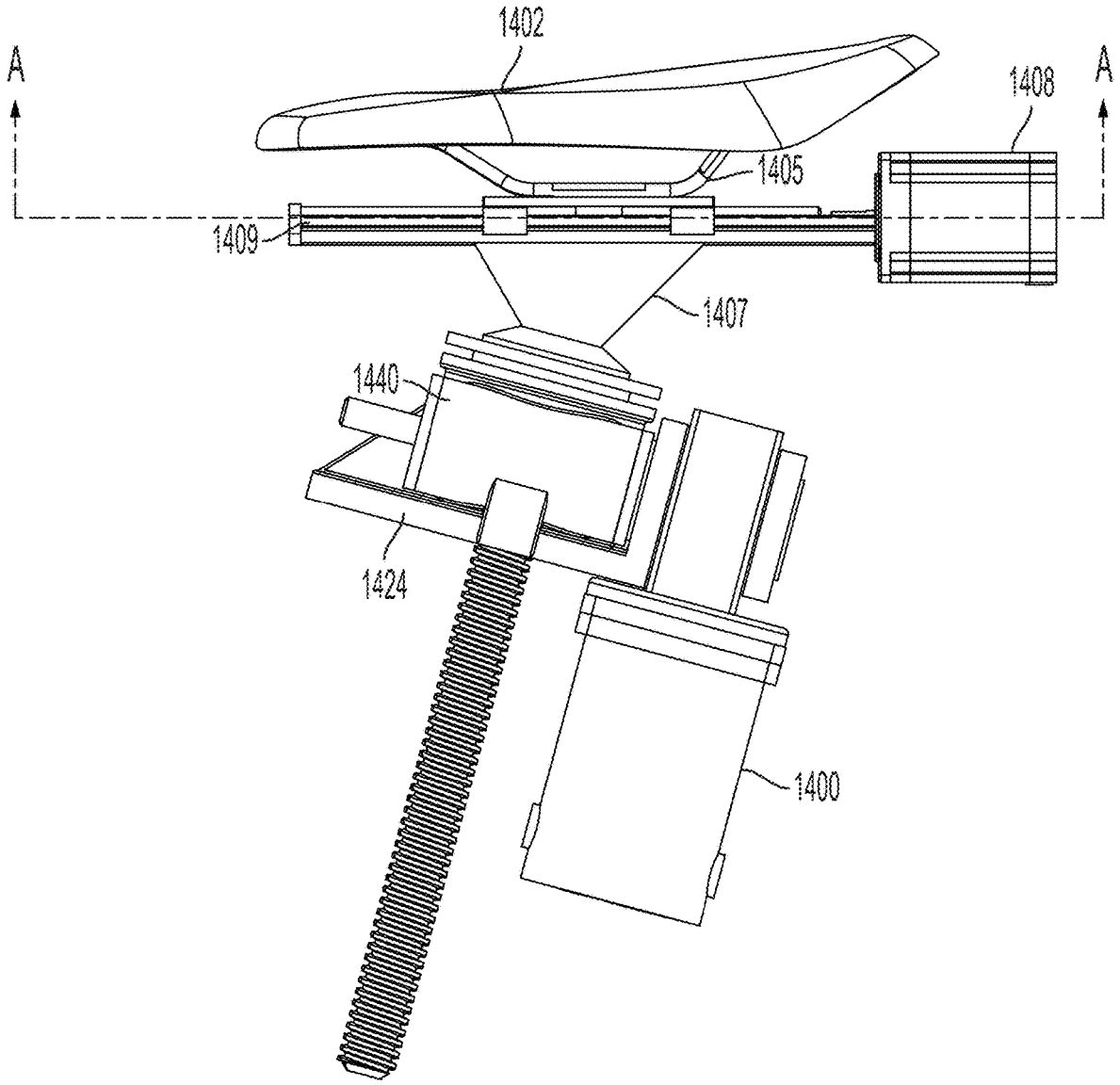
FIG. 21 is a side plan view of the seat of FIG. 20.
Figure 22:
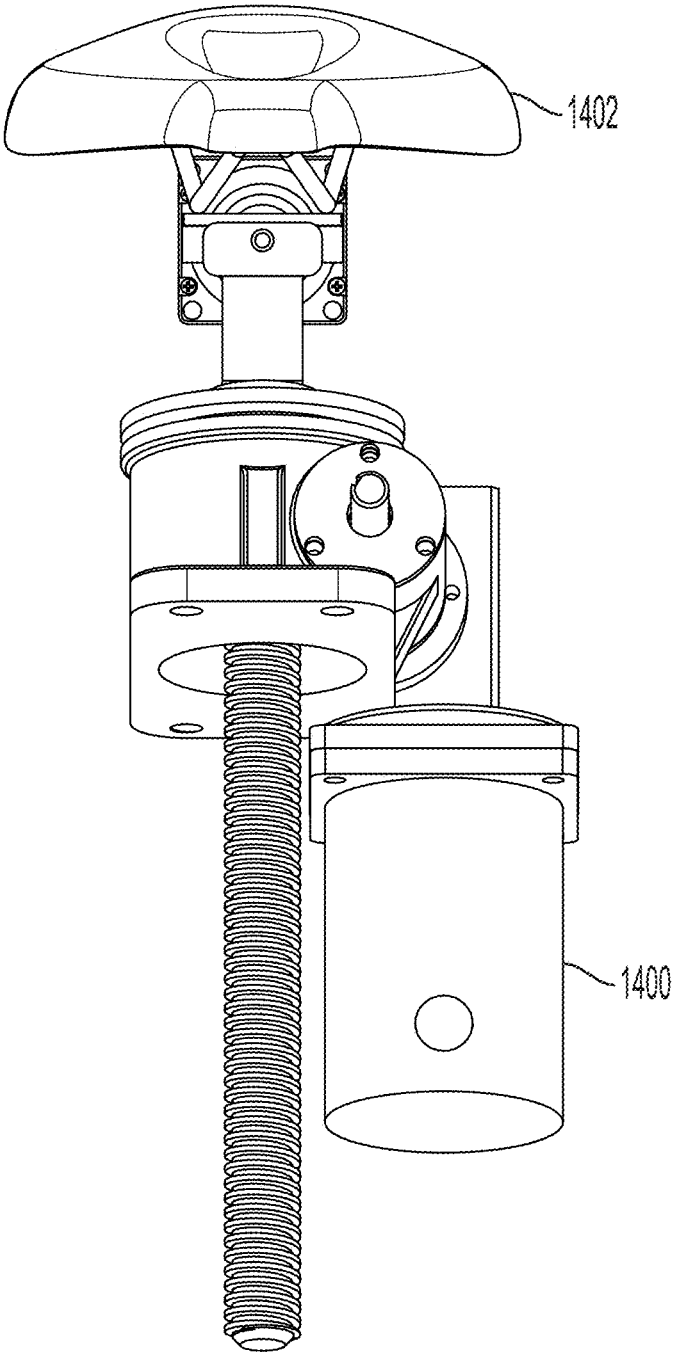
FIG. 22 is a front plan view of the seat of FIG. 20.
Figure 23:
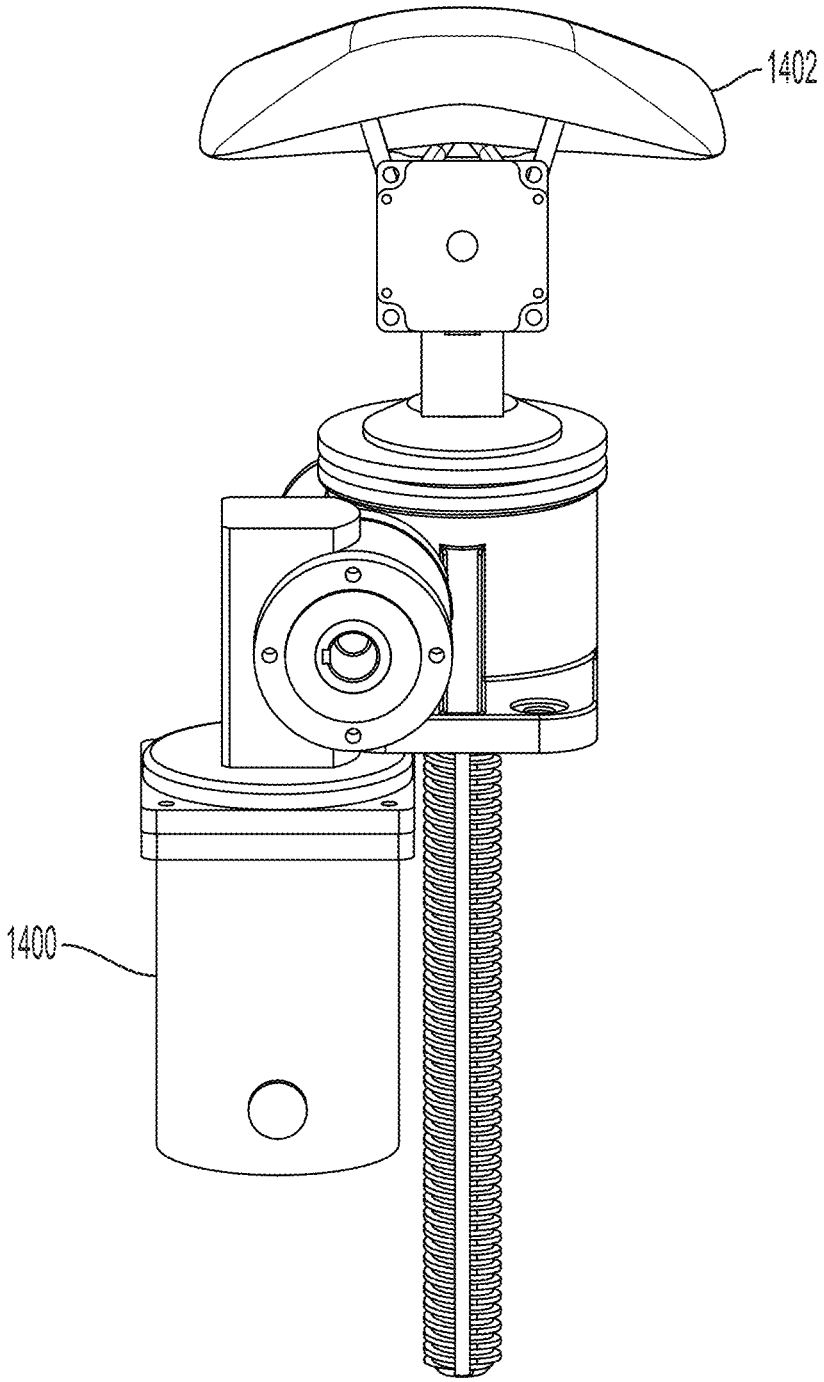
FIG. 23 is a rear plan view of the seat of FIG. 20.

FIGS. 20 through 28 illustrate an example seat configuration in more detail. It should be understood that such construction also could be used to implement a handlebar stem. FIG. 20 is a perspective view of an example configuration of the seat. FIG. 21 is a side plan view of the seat of FIG. 20. FIG. 22 is a front plan view of the seat of FIG. 20. FIG. 23 is a rear plan view of the seat of FIG. 20. Numbering of elements from FIGS. 14 through 19 continues in FIGS. 20 through 28.

Figure 24:
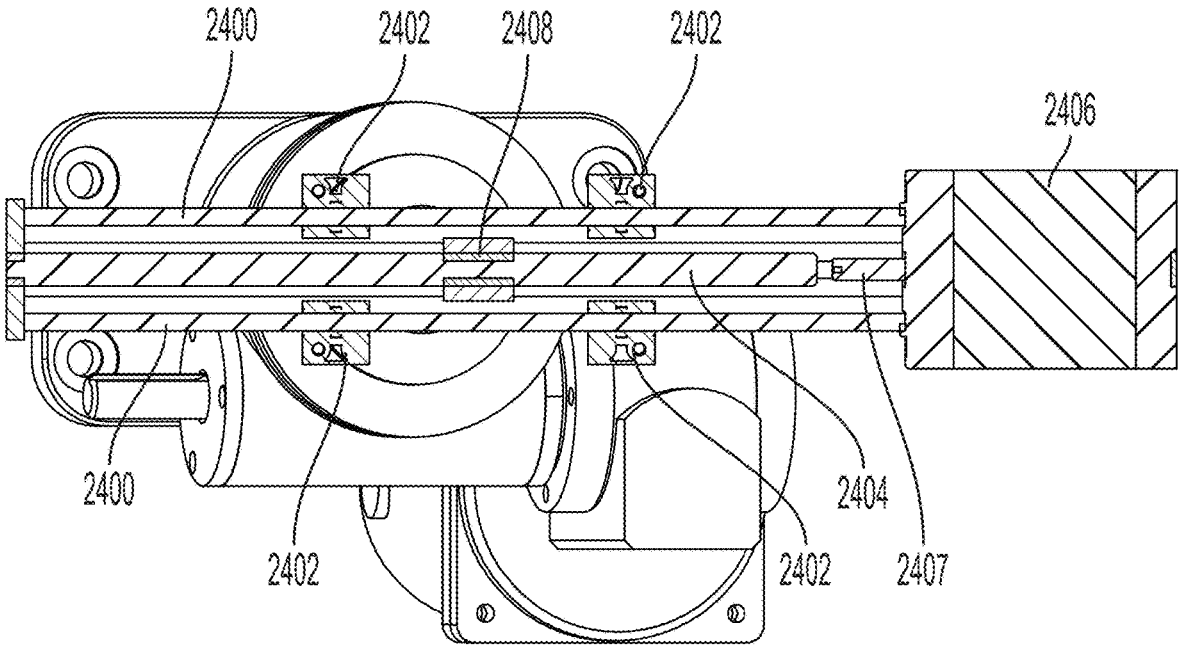
FIG. 24 is a cross section of the lateral motor assembly for the seat illustrated at line A-A in FIG. 21.

FIG. 24 is a cross section of the lateral motor assembly for the seat. The assembly has rails 2400 along which four supports 2402 slide. The four supports 2402 are affixed to or integrated into a center support (not shown). A drive screw 2404 is driven by the shaft 2407 of the motor 2406. A center support also is connected to an internal nut 2408, which is attached to and moves along the drive screw 2404. A bracket supporting the seat attaches to the center support, which is attached to the internal nut 2408 and the four supports 2402.

Figure 25:
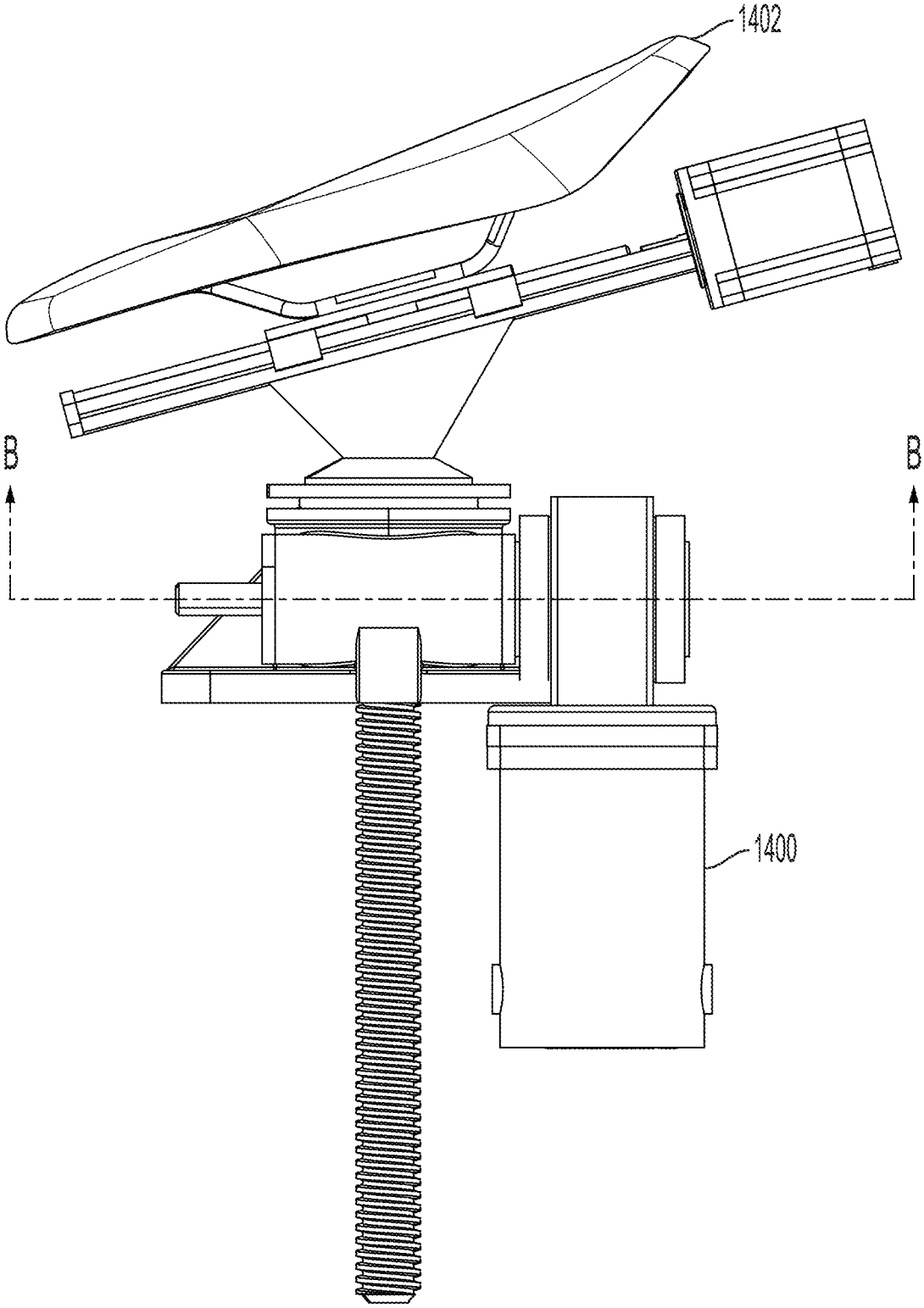
FIG. 25 is a side plan view of the seat of FIG. 20, rotated with respect to FIG. 21.
Figure 26:
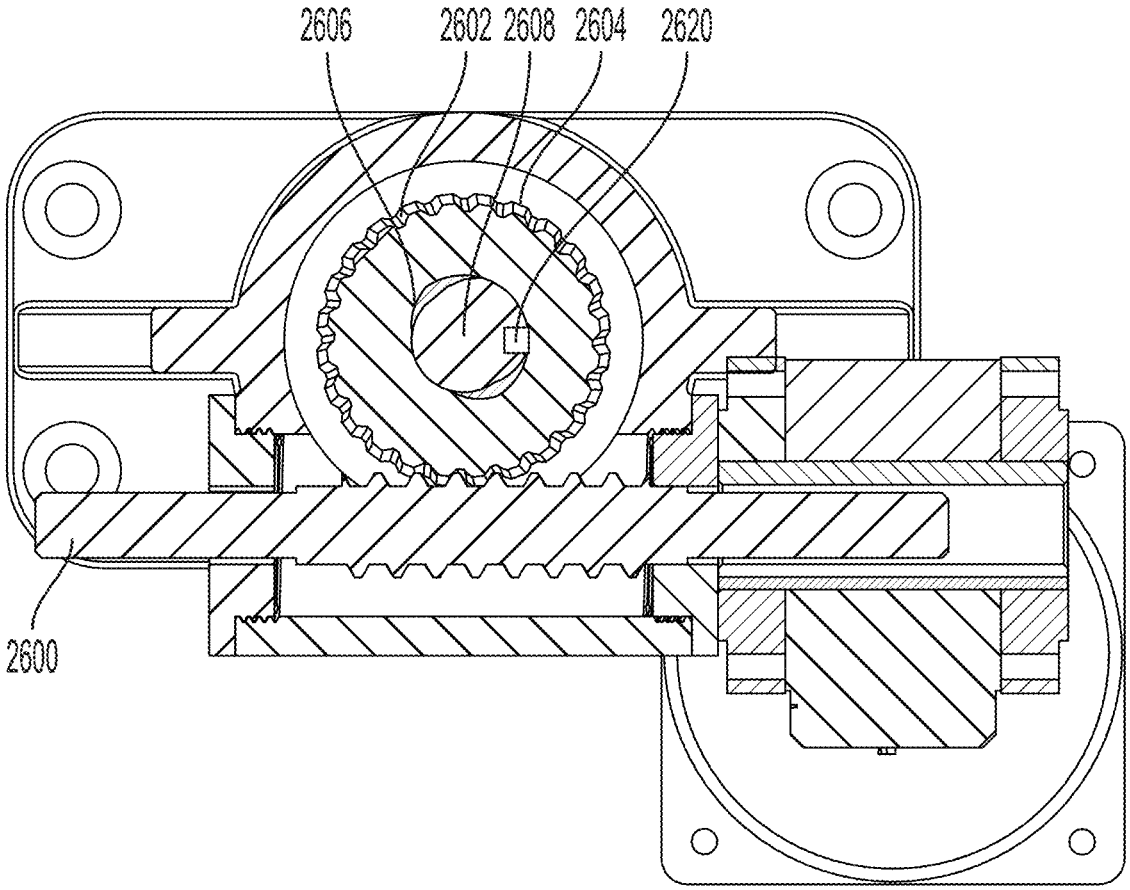
FIG. 26 is a cross section of the support assembly of the seat illustrated at line B-B in FIG. 25.

FIG. 25 is a side plan view of the seat of FIG. 20, rotated with respect to FIG. 21. FIG. 26 is a cross section of the support assembly of the seat as illustrated in FIG. 25. In FIG. 26, a worm drive screw 2600 is caused to rotate by the motor in either direction. The threads of the worm drive screw 2600 engages device 2602 which is formed as a worm gear on its exterior surface 2604, and is threaded on its interior surface 2606, directly interfacing with the seat post 2608. The seat post 2608 is threaded, so that in response to rotation of the device 2602 (in response to rotation of the worm drive screw 2600) the seat post 2608 moves up or down. Such an assembly can be implemented using a device such as shown in FIG. 7. Some features from FIG. 7, such as load bearings, are omitted in FIGS. 26 and 28 to simplify illustration. As further noted below in FIGS. 27 and 28, the seat post 2608 has a groove to engage a guide (see 2620) which prevents rotational of the seat post and the seat attached to it.

Figure 27:
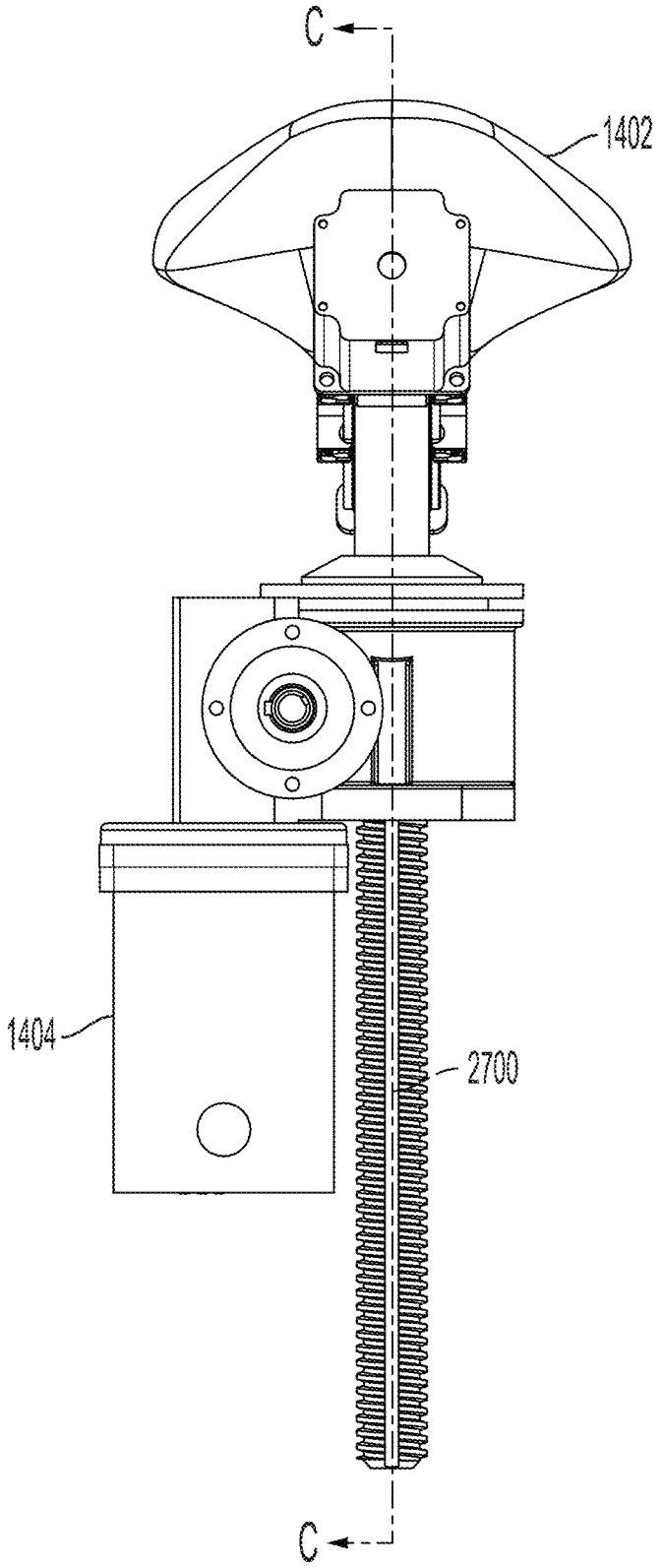
FIG. 27 is a back plan view of the seat as illustrated in FIG. 25.
Figure 28:
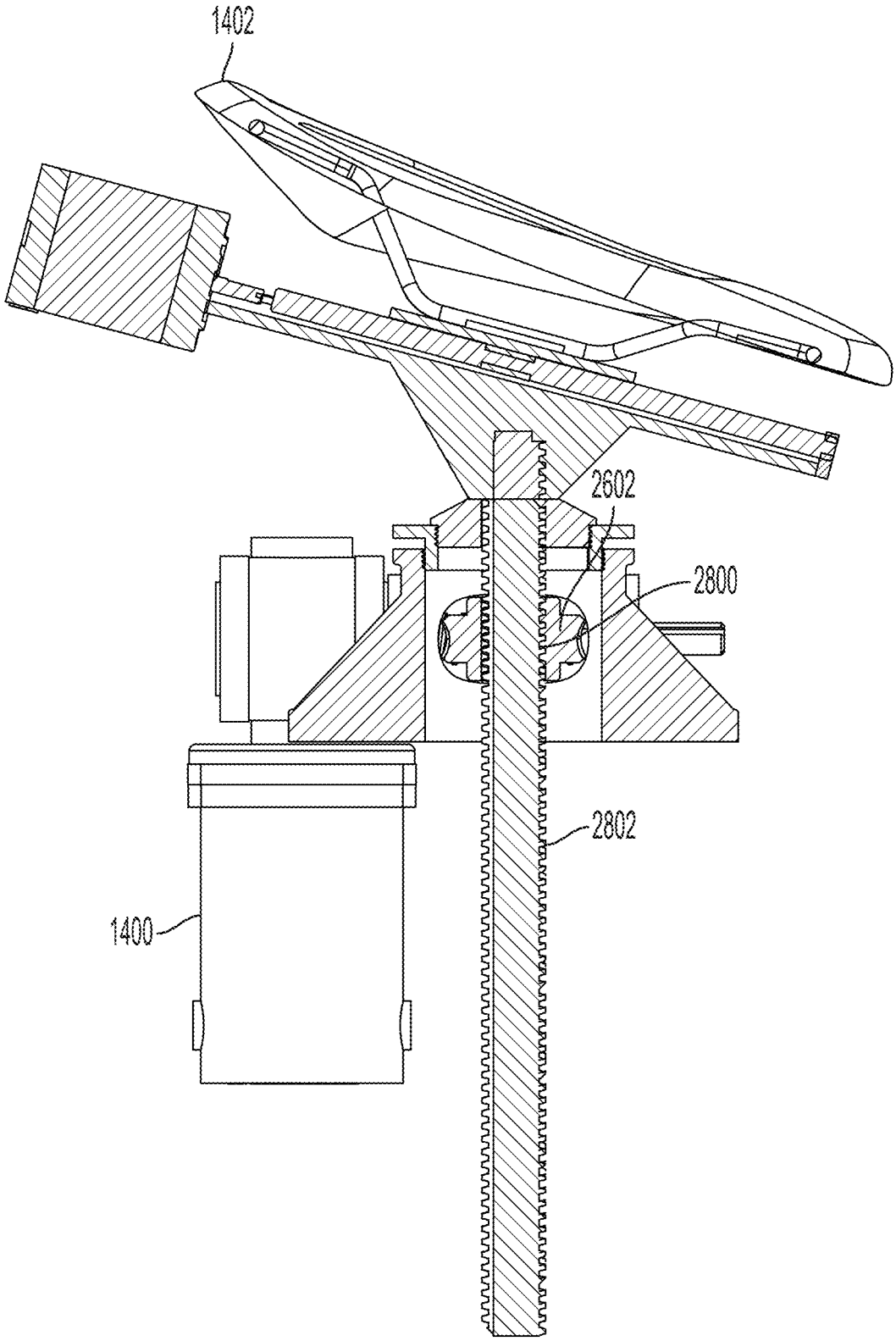
FIG. 28 is a cross section of the seat as illustrated at line C-C in FIG. 27.

FIG. 27 is a back plan view of the seat as illustrated in FIG. 25. FIG. 28 is a cross section of the seat as illustrated in FIG. 27. In FIG. 27, a groove 2700 in the seat post is shown. In FIG. 28, more details of the worm drive motor are shown. As noted above and shown in FIG. 28, the device 2602 is threaded on its interior surface as indicated at 2800. The seat post also is threaded as indicated at 2802, so that in response to rotation of the device 2602 (in response to rotation of the worm drive screw) the seat post moves up or down.

Figure 29:
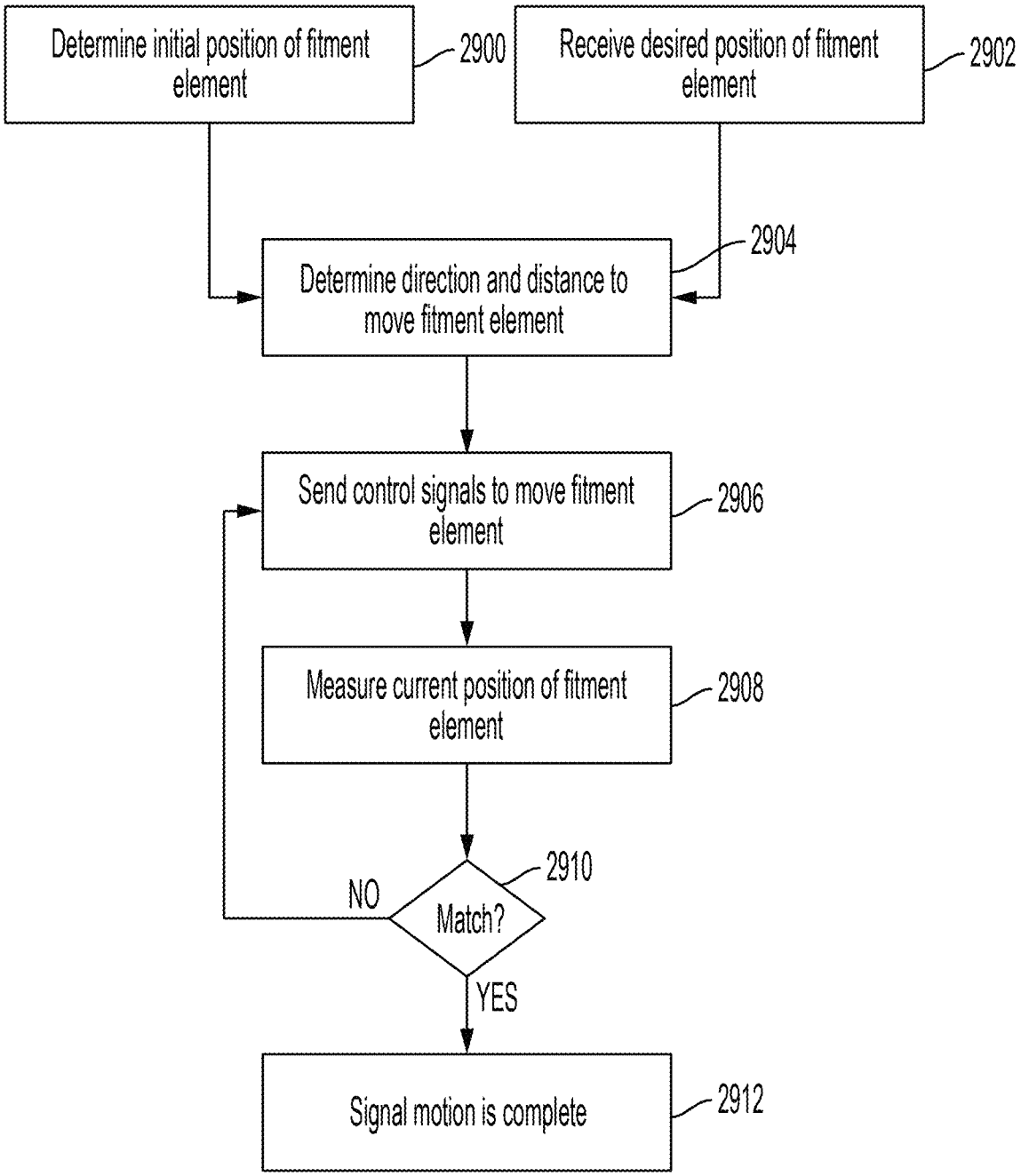
FIG. 29 is a flowchart of an example implementation of setting a position of a ergonomic feature.

Turning now to FIG. 29, a flowchart describing an example implementation of operation of a control system for such exercise equipment will now be described. This flowchart relates to the operation of automatically setting up the exercise device so that the ergonomic features are positioned according to stored settings for an individual. The process is repeated for each ergonomic feature that can be adjusted.

The control system 2900 determines the current position of an ergonomic feature and receives 2902 the desired position of the ergonomic feature. The current position is based on input from a sensor on the ergonomic feature. In some implementations, the desired position can be received by requesting stored position data from a database. In some implementations, the desired position can be received by requesting stored position data from a local storage device. In some implementations, the desired position is an absolute position. In some implementations, the desired position can be a relative position. In some implementations, the desired position can be an input indicating a desired direction of movement of the ergonomic feature received from a user through a user interface device. In some implementations, the desired position can be computed based on data such dimension of an individual's body.

The control system determines 2904 a drive amount, i.e., at least a direction and a distance, to move the ergonomic feature based on at least the current position and desired position. The control system then sends 2906 control signals to move the ergonomic feature. The nature of the control signals depends on the motor assembly of the ergonomic feature. Typically, the control signals indicate a direction of rotation of the motor and an angular velocity, if the motor has more than one speed. The control system enters into a feedback loop wherein it measures 2908 the current position of the ergonomic feature using its sensor, and determines 2910 whether the current position matches the desired position. If no, the control system continues to send (2906, 2908, 2910) control signals to move the motor until the desired position is reached. After the desired position is reached, the control system can signal 2912 that setup of the ergonomic feature has completed.

In some implementations, a variety of error or fault detection processes can be included in the control system. For example, in the loop of operations 2906, 2908, 2910 in FIG. 29, an error or fault detect step can be used to ensure the control loop does not continue indefinitely. In some implementations, a timeout can be used to end the control loop. In some implementations, a lack of sufficient change in the current position over time can be used as a fault detector. In some implementations, the sensor for the motor may provide data from which error conditions can be detected. In some implementations, an additional sensor can provide data from which error conditions can be detected. In some implementations, the control system can continuously analyze the current position data with respect to the user's desired position data during use of the equipment to verify that the ergonomic features remain within an expected range of their originally set positions. In some implementations, the control system can verify that the feedback data is within range of what the system expects. In other words, if the position provided by the sensors indicates a value of outside that is out of range, then the control system can signal a fault or error (due to invalid data) rather than continuing to loop in an effort to hit the target position.

Figure 30:
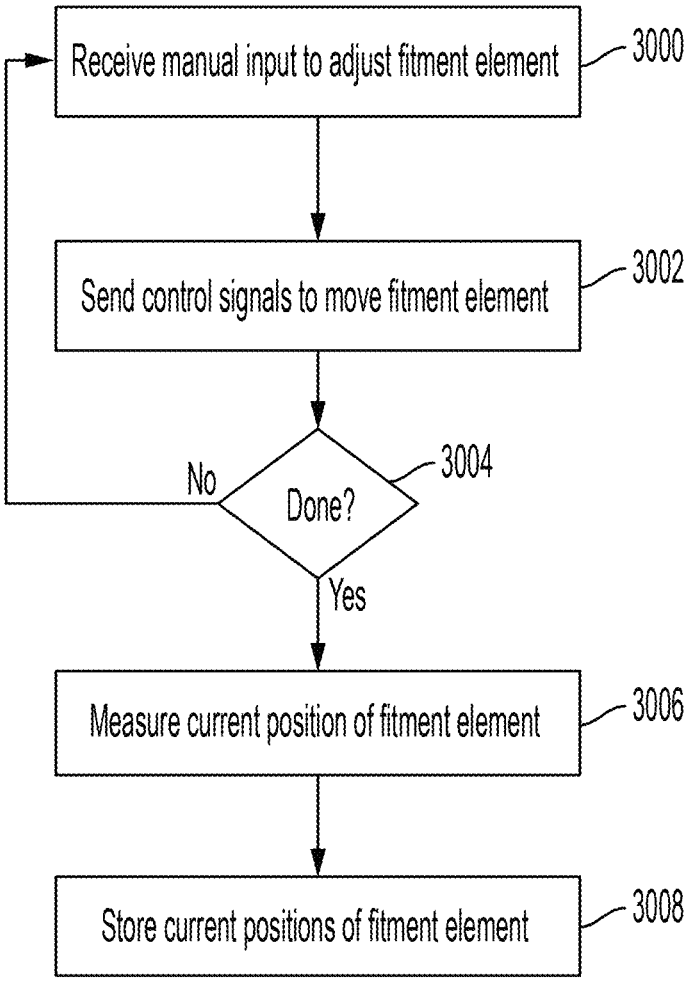
FIG. 30 is a flowchart describing an example implementation of an operation of manually setting up an exercise device.

Turning now to FIG. 30, a flowchart describing an example implementation of operation of a control system for such exercise equipment will now be described. This flowchart relates to the operation of manually setting up the exercise device in response to user input so that the ergonomic features are positioned at desired positions, and settings for those positions are then stored for an individual.

On the exercise device, a user interface device can be provided to allow a user to indicate a direction of movement of an ergonomic feature. In some implementations, such a user interface device can include one or more buttons, switches, or other electromechanical devices. The control system 3000 receives this manual input. In response to the manual input, the control system sends 3002 control signals to the motor assembly to move the ergonomic feature. If the control system determines 3004 that the manual input is still being received, as indicated at 3004/3000, the control system continues to send 3002 the control signal to the motor assembly.

When manual movement of the ergonomic feature has completed, the control system can measure 3006 the current position of the ergonomic feature, by using the sensor. The control system can store 3008 the current position for the user. In some implementations, the storage of the current position can include overwriting any previously stored position data, or prompting the user to confirm whether any previously stored position data should be overwritten.

In some implementations, the control system also could have a set of predefined positions for an ergonomic feature, or predefined combinations of positions for ergonomic features. Under manual operation, the user could select from among the set of predefined positions in order to set their desired position. The user could cycle among those positions until the best fit is identified.

Such manual adjustment can be performed for each dimension of movement of the ergonomic feature, and then for each ergonomic feature. In some implementations, the control system can prompt the user for each setting for each dimension and for each ergonomic feature, providing some information through a user interface device indicating the dimension and ergonomic feature currently being processed by the control system. In some implementations, the control system can provide feedback and recommendations through the user interface device to the user about how the current dimension should be set for ideal ergonomic effect.

Figure 31:
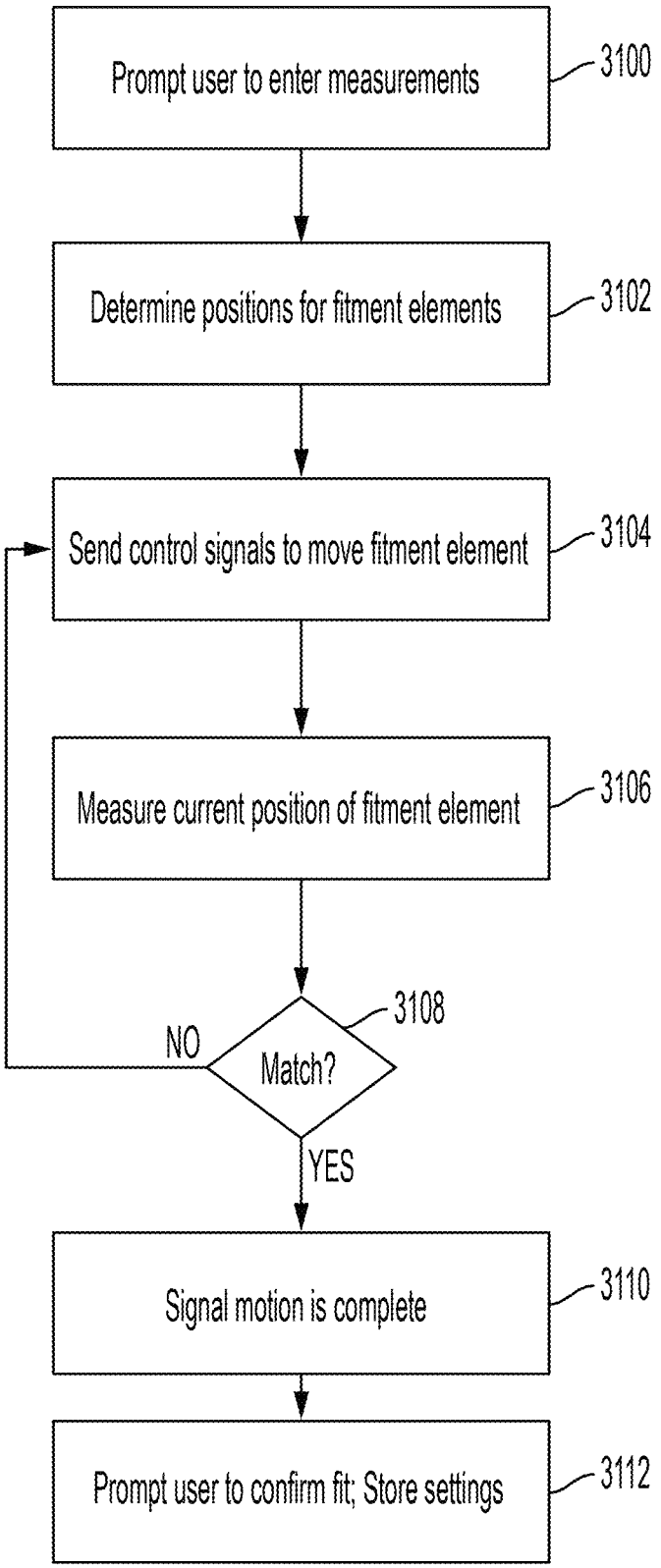
FIG. 31 is a flowchart describing an example implementation of an operation of semi-automatically setting up an exercise device.

Turning now to FIG. 31, a flowchart describing an example implementation of operation of a control system for such exercise equipment will now be described. This flowchart relates to the operation of semi-automatically setting up the exercise device in response to user specifications so that the ergonomic features are positioned at positions expected to ergonomically fit the individual, and final settings are then stored for an individual.

The control system 3100 can prompt the user to enter measurements. In some implementations, the measurements can be input by user through a user interface device by manually entering specific measurements for certain body parts or combinations of body parts in different poses. In some implementations, the control system can capture one or more images of the user, and measurements can be derived from one or more images.

Given the input measurements, the control system determines 3102 the positions for the ergonomic features. Generally, the positions of the ergonomic features have one or more ideal ergonomic positions for an individual based on the individual's measurements which can be computed using known techniques and simple geometry.

Given the desired positions and current positions of the ergonomic features, the control system can then compute a drive amount and then send 3104 corresponding control signals to the motor assembly of the ergonomic feature. The control system measures 3106 the current position of the control element and continues to move the control element until the current position and the desired position match, as indicated at 3108. The process of steps 3104 through 3108 repeats for each dimension of each ergonomic feature.

When the ergonomic feature(s) has/have been moved to their desired positions, the control system can signal 3110 to the user that setup is complete. Through a user interface device, the control system can prompt 3008 the user and receive a user's response to confirm whether the resulting fit is adequate. If approved the control system can store the current position for the user. In some implementations, the storage of the current position can include overwriting any previously stored position data, or prompting the user to confirm whether any previously stored position data should be overwritten.

It should be understood that, in some implementations, the steps 3100 through 3108 can be done sequentially for each dimension of each ergonomic feature. In some implementations, the desired positions for each ergonomic feature can be determined first, and then the ergonomic features can be moved by the control system. In some implementations, these steps can be combined iteratively with manual settings of the ergonomic features.

Figure 32:
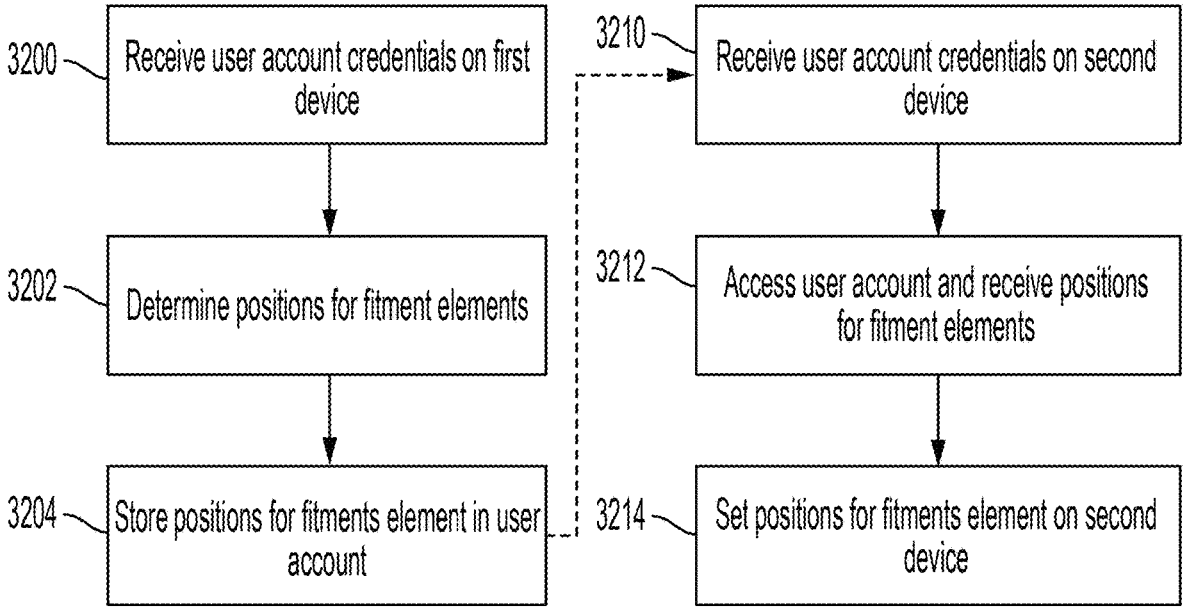
FIG. 32 is a flowchart describing an example implementation of operations supporting re-use of settings for positions of ergonomic features.

Turning now to FIG. 32, a flowchart describing an example implementation of operation of a control system for such exercise equipment will now be described. This flowchart illustrates how the system enables an individual to establish settings for the ergonomic features using a first exercise device, but then re-use those settings on a second exercise device.

When the user is using a first exercise device, that exercise device can receive 3200 account credentials for that user. After determining 3202 positions for ergonomic features for the user on the first exercise device, the computing device on the first exercise device stores 3204 position data indicative of the positions for these ergonomic features in a user account. In some implementations, the data can be stored in a removable storage device that connects to the first exercise device. In some implementations, the computing device of the exercise device can connect over a computer network to a server computer that houses a database which stores such information for each user.

When the user switches to using a second exercise device, the computing device on the second exercise device receives 3210 the user's credentials for their account. The computing device accesses 3212 the user's account, such as by accessing a local removable storage device or a remote server computer, to receive the position data stored in that user's account which indicates the positions for the ergonomic features. The second exercise device then configures itself by setting 3214 the positions of the ergonomic features based on the data retrieved from the user's account. In some implementations, if a transform is known for translating settings for positions of ergonomic features of one kind of exercise device into settings for positions of ergonomic features of another kind of exercise device, then the control system can include programming to apply such a transform to allow such settings to be shared between different kinds of devices.

Figure 33:
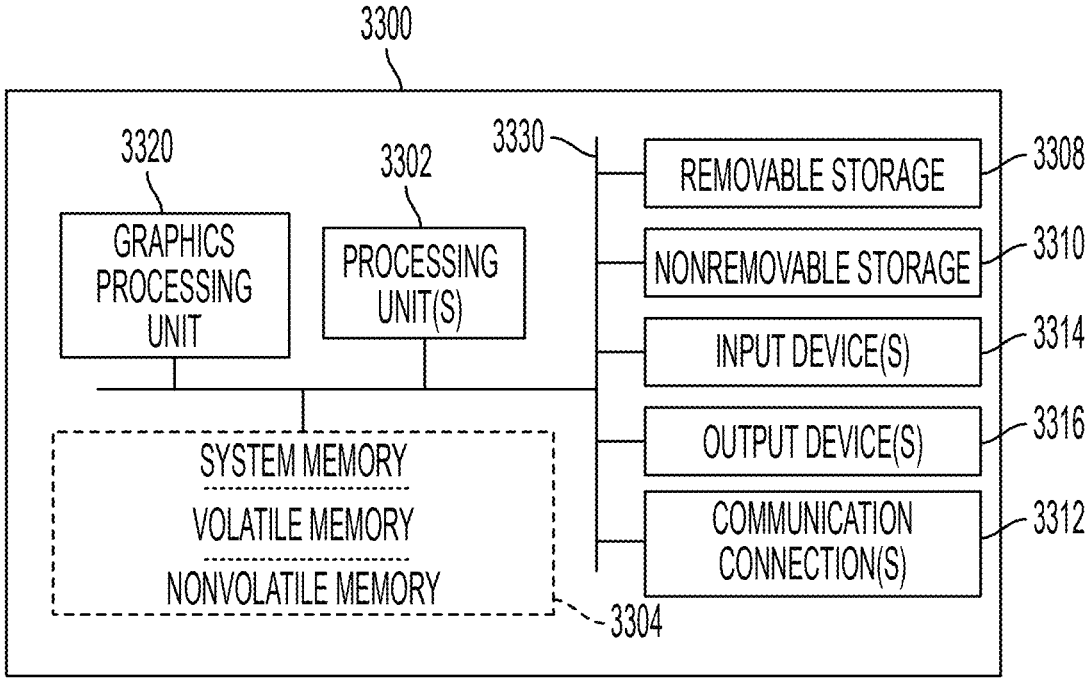
FIG. 33 is a block diagram of an example general purpose computer.

FIG. 33 is a block diagram of a general-purpose computer which processes computer programs using a processing system. Computer programs on a general-purpose computer generally include an operating system and applications. The operating system is a computer program running on the computer that manages access to resources of the computer by the applications and the operating system. The resources generally include memory, storage, communication interfaces, input devices and output devices.

Examples of such general-purpose computers include, but are not limited to, larger computer systems such as server computers, database computers, desktop computers, laptop and notebook computers, as well as mobile or handheld computing devices, such as a tablet computer, handheld computer, smartphone, media player, personal data assistant, audio and/or video recorder, or wearable computing device.

With reference to FIG. 33, an example computer 3300 comprises a processing system including at least one processing unit 3302 and computer storage, such as a memory 3304. The computer can have multiple processing units 3302 and multiple devices implementing the memory 3304. A processing unit 3302 can include one or more processing cores (not shown) that operate independently of each other. Additional co-processing units, such as graphics processing unit 3320, also can be present in the computer. The memory 3304 may include volatile devices (such as dynamic random-access memory (DRAM) or other random-access memory device), and non-volatile devices (such as a read-only memory, flash memory, and the like) or some combination of the two, and optionally including any memory available in a processing device. Other memory such as dedicated memory or registers also can reside in a processing unit. Such a memory configuration is delineated by the dashed line 3304 in FIG. 33. The computer 3300 may include additional storage (removable and/or non-removable) including, but not limited to, solid state devices, or magnetically recorded or optically recorded disks or tape. Such additional storage is illustrated in FIG. 33 by removable storage 3308 and non-removable storage 3310. The various components in FIG. 33 are generally interconnected by an interconnection mechanism, such as one or more buses 3330.

A computer storage medium is any medium in which data can be stored in and retrieved from addressable physical storage locations by the computer. Computer storage media includes volatile and nonvolatile memory devices, and removable and non-removable storage devices. Memory 3304, removable storage 3308 and non-removable storage 3310 are all examples of computer storage media. Some examples of computer storage media are RAM, ROM, EEPROM, flash memory or other memory technology, CD-ROM, digital versatile disks (DVD) or other optically or magneto-optically recorded storage device, magnetic cassettes, magnetic tape, magnetic disk storage or other magnetic storage devices. Computer storage media and communication media are mutually exclusive categories of media.

The computer 3300 may also include communications connection(s) 3312 that allow the computer to communicate with other devices over a communication medium. Communication media typically transmit computer program code, data structures, program modules or other data over a wired or wireless substance by propagating a modulated data signal such as a carrier wave or other transport mechanism over the substance. The term "modulated data signal" means a signal that has one or more of its characteristics set or changed in such a manner as to encode information in the signal, thereby changing the configuration or state of the receiving device of the signal. By way of example, and not limitation, communication media includes wired media such as a wired network or direct-wired connection, and wireless media include any non-wired communication media that allows propagation of signals, such as acoustic, electromagnetic, electrical, optical, infrared, radio frequency and other signals. Communications connections 3312 are devices, such as a network interface or radio transmitter, that interface with the communication media to transmit data over and receive data from signals propagated through communication media.

The communications connections can include one or more radio transmitters for telephonic communications over cellular telephone networks, and/or a wireless communication interface for wireless connection to a computer network. For example, a cellular connection, a Wi-Fi connection, a Bluetooth connection, and other connections may be present in the computer. Such connections support communication with other devices, such as to support voice or data communications.

The computer 3300 may have various input device(s) 3314 such as a various pointer (whether single pointer or multi-pointer) devices, such as a mouse, tablet and pen, touchpad and other touch-based input devices, stylus, image input devices, such as still and motion cameras, audio input devices, such as a microphone. The computer may have various output device(s) 3316 such as a display, speakers, printers, and so on, also may be included. These devices are well known in the art and need not be discussed at length here.

The various storage 3310, communication connections 3312, output devices 3316 and input devices 3314 can be integrated within a housing of the computer, or can be connected through various input/output interface devices on the computer, in which case the reference numbers 3310, 3312, 3314 and 3316 can indicate either the interface for connection to a device or the device itself as the case may be.

An operating system of the computer typically includes computer programs, commonly called drivers, which manage access to the various storage 3310, communication connections 3312, output devices 3316 and input devices 3314. Such access generally includes managing inputs from and outputs to these devices. In the case of communication connections, the operating system also may include one or more computer programs for implementing communication protocols used to communicate information between computers and devices through the communication connections 3312.

Any of the foregoing aspects may be embodied as a computer system, as any individual component of such a computer system, as a process performed by such a computer system or any individual component of such a computer system, or as an article of manufacture including computer storage in which computer program code is stored and which, when processed by the processing system(s) of one or more computers, configures the processing system(s) of the one or more computers to provide such a computer system or individual component of such a computer system.

Each component (which also may be called a "module" or "engine" or "computational model" or the like), of a computer system such as described herein, and which operates on one or more computers, can be implemented as computer program code processed by the processing system(s) of one or more computers. Computer program code includes computer-executable instructions and/or computer-interpreted instructions, such as program modules, which instructions are processed by a processing system of a computer. Generally, such instructions define routines, programs, objects, components, data structures, and so on, that, when processed by a processing system, instruct the processing system to perform operations on data or configure the processor or computer to implement various components or data structures in computer storage. A data structure is defined in a computer program and specifies how data is organized in computer storage, such as in a memory device or a storage device, so that the data can accessed, manipulated, and stored by a processing system of a computer.

One or more computers can be used to implement such a computational pipeline, using one or more general-purpose computers, such as client devices including mobile devices and client computers, one or more server computers, or one or more database computers, or combinations of any two or more of these, which can be programmed to implement the functionality such as described in the example implementations.

While the foregoing description is provided using an upright cycle with adjustable seat and handlebars, the invention is not limited thereto. The use of stored user settings to control an actuator for position adjustment can be applied to other kinds of exercise cycles and other kinds of exercise equipment with adjustable ergonomic features. These techniques can be used for exercise equipment that is not stationary or in a fixed location. For example, these techniques can be used for bicycles for road use and would be particularly useful for rental bicycles.

Such techniques also can be applied to motor vehicles, including both commercial and personal vehicles, where user preferences for seat, steering wheel, and mirror positions, as well as climate control and entertainment system settings, can all be managed and controlled based on user login credentials. These techniques would be particularly useful for fleets of vehicles and rental cars where multiple users each use multiple vehicles within the collection of vehicles.

The following patent documents form a part of this Specification, and are hereby incorporated by reference herein, except for any subject matter disclaimers or disavowals, and except to the extent that the incorporated material is inconsistent with the express disclosure herein, in which case the language in this disclosure controls: U.S. Pat. Nos. 11,203,388, 10,953,950, 10,676,146, 6,050,585, 10,513,300, 11,680,426, PCT Publication WO 2022/220733, U.S. Patent Publication 2013/0225370, U.S. Patent Publication 2020/0269941, and U.S. Patent Publication 2023/0023599.

It should be understood that the subject matter defined in the appended claims is not necessarily limited to the specific implementations described above. The specific implementations described above are disclosed as examples only.

What is claimed is:

1. Exercise equipment, comprising:

a frame comprising a plurality of interconnected members;

a post configured to be installed in a first member of the plurality of interconnected members and configured to be connected to a support component adapted to be physically engaged by a body part of an individual using the exercise equipment;

a first motor assembly including a first motor affixed to the frame and a first moving member connected to the post, the first moving member configured to be moved by the first motor in response to a drive signal input to the first motor assembly to move the post along the first member with a first range of motion between a first position and a second position;

a first sensor configured to sense a first current position of the first moving member along the first range of motion and having an output providing a signal indicative of the first current position;

a second motor assembly including a second motor configured to be affixed to the post and a second moving member adapted to be connected to the support component, the second moving member configured to be moved by the second motor in response to a second drive signal input to the second motor assembly to move the second moving member laterally with respect to the post with a second range of motion between a third position and a fourth position;

a second sensor configured to sense a second current position of the second moving member along the second range of motion and having an output providing a signal indicative of the second current position; and a computing device including computer program instructions that configure the computing device to:

receive data describing a desired position of the post, receive data based on the signal indicative of the first current position, determine a first drive amount for the first motor assembly based on at least the desired position of the post and the first current position, output the first drive signal to the first motor assembly based on the determined first drive amount, receive data describing a desired position of the support member, receive data based on the signal indicative of the second current position, determine a second drive amount for the second motor assembly based on at least the desired position of the support member and the second current position, and output the second drive signal to the second motor assembly based on the determined second drive amount.

2. The exercise equipment of claim 1, wherein the first member comprises a seat tube forming part of a back section of the exercise equipment.

3. The exercise equipment of claim 2, wherein the post comprises a seat post.

4. The exercise equipment of claim 3, further comprising the support component, wherein the support component comprises a seat.

5. The exercise equipment of claim 1, wherein the first member comprises a head tube forming part of a front section of the exercise equipment.

6. The exercise equipment of claim 5, wherein the post comprises a stem for a handlebar.

7. The exercise equipment of claim 6, further comprising the support component, wherein the support component comprises a handlebar.

8. The exercise equipment of claim 1, wherein the second range of motion comprises an angular range of motion.

9. The exercise equipment of claim 1, wherein the second range of motion comprises a linear range of motion.

10. The exercise equipment of claim 1, wherein the computing device is further configured to, in response to a user input, store, in computer storage, the first current position and the second current positions as settings of the ergonomic feature for the user.

11. The exercise equipment of claim 1, wherein the frame comprises a frame for a bicycle adapted for road use.

* * * * *